US010465939B2

(12) United States Patent
Penlesky et al.

(10) Patent No.: US 10,465,939 B2
(45) Date of Patent: Nov. 5, 2019

(54) VENTILATION DAMPER SYSTEM AND METHOD

(71) Applicant: Broan-NuTone LLC, Hartford, WI (US)

(72) Inventors: Robert G. Penlesky, Waukesha, WI (US); Kenneth J. Jonas, Mequon, WI (US); Corey Scott Jacak, West Bend, WI (US)

(73) Assignee: Broan-NuTone LLC, Hartford, WI (US)

( * ) Notice: Subject to any disclaimer, the term of this patent is extended or adjusted under 35 U.S.C. 154(b) by 858 days.

(21) Appl. No.: 14/546,035

(22) Filed: Nov. 18, 2014

(65) Prior Publication Data

US 2015/0140923 A1 May 21, 2015

Related U.S. Application Data

(60) Provisional application No. 61/905,781, filed on Nov. 18, 2013, provisional application No. 61/935,754, filed on Feb. 4, 2014.

(51) Int. Cl.
*F24F 13/10* (2006.01)
*F24F 7/007* (2006.01)

(52) U.S. Cl.
CPC ..... *F24F 13/10* (2013.01); *F24F 7/007* (2013.01)

(58) Field of Classification Search
CPC ..... F24F 13/10; F24F 7/007; F24F 2007/002
(Continued)

(56) References Cited

U.S. PATENT DOCUMENTS 2,058,996 A * 10/1936 Kollberg ..... F16K 1/226 251/306
2,733,889 A * 2/1956 Mattingly ..... F24F 13/1406 126/292

(Continued)

FOREIGN PATENT DOCUMENTS

CN 1590817 3/2005
JP 10-328323 A 12/1995

(Continued)

OTHER PUBLICATIONS

"International Application Serial No. PCT/US2014/066053, International Search Report dated Feb. 25, 2015", 3 pgs.

(Continued)

*Primary Examiner* — Gregory L Huson
*Assistant Examiner* — Dana K Tighe
(74) *Attorney, Agent, or Firm* — Barnes & Thornburg LLP

(57) ABSTRACT

A damper assembly having a main body defining a continuous fluid path extending between a first opening and a second opening and a damper door rotatable within the main body to control the flow of fluid through the main body. The main body including an engagement edge extending circumferentially on an inner surface of the main body. The damper door can be rotated relative to the main body to sealingly engage an outer edge of the damper door with the engagement edge. The engagement edge of the main body can be oriented on the inner surface such that the surface area of the outer edge such that engagement of the engagement edge gradually increases as the damper door is rotated to seal the damper door to the main body.

35 Claims, 22 Drawing Sheets

(58) Field of Classification Search
USPC ..... 454/322, 323, 327
See application file for complete search history.

(56) References Cited

U.S. PATENT DOCUMENTS

| | | | | | |
|---|---|---|---|---|---|
| 3,901,135 | A * | 8/1975 | Nilsson | F24F 13/06 | 454/322 |
| 4,236,668 | A * | 12/1980 | Prikkel, III | F23L 13/02 | 126/285 R |
| 4,867,640 | A * | 9/1989 | Penlesky | F04D 29/626 | 415/204 |
| 5,879,232 | A * | 3/1999 | Luter, II | F04D 25/08 | 454/349 |
| 6,962,324 | B2 * | 11/2005 | Bunn | B64D 13/02 | 251/301 |
| 7,175,309 | B2 * | 2/2007 | Craw | F21V 29/02 | 362/149 |
| 7,273,062 | B1 * | 9/2007 | Stender, Jr. | F16K 17/32 | 137/2 |
| 8,430,731 | B2 * | 4/2013 | Bamberger | F24F 13/14 | 137/315.16 |
| 2006/0219381 | A1 | 10/2006 | Lagace et al. | | |

FOREIGN PATENT DOCUMENTS

| | | | |
|---|---|---|---|
| JP | 08-075212 | A | 3/1996 |
| JP | 2011-191020 | A | 9/2011 |
| WO | WO-2007/059582 | A1 | 5/2007 |

OTHER PUBLICATIONS

"International Application Serial No. PCTIUS2014/066053, Written Opinion dated Feb. 25, 2015", 13 pgs.

Office Action as issued in Corresponding Chinese Patent Application No. 201480073133.X, dated Apr. 18, 2018.

English Translation of portions of Apr. 18, 2018 Office Action in Chinese Patent Application No. 201480073133.X.

Office Action as issued in Corresponding Chinese Patent Application No. 201480073133.X, dated Jan. 31, 2019.

English Translation of portions of Jan. 31, 2019 Office Action in Chinese Patent Application No. 201480073133.X.

* cited by examiner

| Conventional Flap | | | | | |
|---|---|---|---|---|---|
| Ps | CFM | CFMn | RPM | Watts | Sones |
| 0.000 | 93.1 | 90.7 | 680 | 29.2 | 0.283 |
| 0.100 | 82.1 | 80.0 | 777 | 28.9 | 0.493 |
| 0.125 | 80.5 | 78.4 | 810 | 28.5 | 0.565 |
| 0.250 | 66.2 | 64.5 | 983 | 27.6 | 1.072 |
| 0.375 | 49.3 | 48.0 | 1084 | 26.6 | 1.447 |
| 0.500 | 30.8 | 30.0 | 1206 | 25.2 | 1.967 |
| 0.611 | 0.0 | 0.0 | 1290 | 23.9 | |

| Example Flap | | | | | |
|---|---|---|---|---|---|
| Ps | CFM | CFMn | RPM | Watts | Sones |
| 0.000 | 96.7 | 94.3 | 598 | 29.4 | 0.072 |
| 0.100 | 82.0 | 80.0 | 718 | 28.9 | 0.285 |
| 0.125 | 78.6 | 76.7 | 750 | 28.6 | 0.355 |
| 0.250 | 64.2 | 62.6 | 919 | 27.7 | 0.795 |
| 0.375 | 43.5 | 42.4 | 1080 | 26.4 | 1.465 |
| 0.500 | 20.3 | 19.8 | 1214 | 24.9 | 2.120 |
| 0.576 | 0.0 | 0.0 | 1250 | 24.4 | |

FIG. 8

VENTILATION DAMPER SYSTEM AND METHOD

CLAIM OF PRIORITY

This patent application claims the benefit of priority, under 35 U.S.C. Section 119(e), to Robert G. Penlesky et al. U.S. Patent Application Ser. No. 61/905,781, entitled "VENTILATION DAMPER SYSTEM AND METHOD," filed on Nov. 18, 2013 and Robert G. Penlesky et al. U.S. Patent Application Ser. No. 61/935,754, entitled "VENTILATION DAMPER SYSTEM AND METHOD," filed on Feb. 4, 2014, which are hereby incorporated by reference herein in their entirety.

TECHNICAL FIELD

This document pertains generally, but not by way of limitation, to ventilation systems having dampers and ventilation damper systems.

BACKGROUND

Ventilating exhaust fans, such as those typically installed in bathrooms, draw air from within a space and pass the exhausted air out to another location, such as by passing the exhausted air through a vent in the gable or roof of a building. Exhaust fans can include a rotating fan wheel having a plurality of vanes that are rotated in a housing to draw an inward airflow from the space through a housing inlet and push an outward airflow through a housing outlet to the other location. Exhaust fans are typically mounted in an aperture of a wall or ceiling of the structure separating the space and the other location by mounting the housing to wall or ceiling joists or other structure in the wall or ceiling.

Certain ventilating exhaust fans include backdraft dampers positioned at the housing outlet to allow the outward airflow through the housing outlet while preventing airflow in the reverse direction. Although backdraft dampers can mitigate backdraft through the housing outlet, often at least some portion of the damper assembly partially obstructs the housing outlet reducing the effective cross-sectional area of the housing outlet. The reduced cross-sectional area of the housing outlet reduces the efficiently of the exhaust fans by obstructing the outward airflow. In addition, the disruption of the airflow from the backdraft damper can amplify noise emission and audible noise generated during the operation of the ventilating exhaust fans. In particular, the shape of the backdraft damper can reflect sound through the ventilation assembly housing amplifying the noise. Similarly, the backdraft damper can be vibrated by the exhaust airflow or pushed against surrounding housing creating additional noise.

OVERVIEW

The present inventors have recognized, among other things, that a problem to be solved can include the audible noise generated and amplified during the operation of a ventilation assembly by the damper assembly for preventing backflow in the ventilation assembly. In an example, the present subject matter can provide a solution to this problem, such as by a damper assembly having a damper door that can be rotatably mounted within a main body to control the flow of fluid through the main body. The damper door can have an outer edge that can be rotated into engagement with an engagement edge of the main body to seal the damper door to the main body and prevent fluid flow through the main body. The engagement edge can be oriented such that the portion of the engagement edge engaged by the outer edge of the damper door gradually increases as the damper door is rotated to close the damper door. The arrangement can reduce vibration of the damper door and the resulting audible noise when the damper door is positioned in the closed position.

In an example, the main body can be curved such that the inner surface of the main body is concave. In this configuration, the outer surface of the damper door can be convex such that the damper door can be rotated such that the outer surface of the damper door is positioned adjacent to the inner surface of the main body reducing obstruction of fluid flow through the main body by the damper door. In at least one example, at least one of the inner surface of the main body and the outer surface of the damper door is padded to reduce noise generated by contact between the damper door and the main body.

In an example, the main body can define a recessed clearance region of the inner surface. At least a portion of the damper door is positioned within the recessed clearance region to increase the cross-sectional area available for fluid flow through the main body.

A damper assembly, in an example, can include a main body defining an inner surface and a continuous fluid path extending between a first opening and a second opening. The main body can include an engagement edge extending circumferentially on the inner surface. The damper assembly can also include a damper door having an outer edge and rotatably mounted to the inner surface of the main body such that the damper door is rotatable relative to the main body between at least an open position and a closed position. A predetermined surface area of the outer edge of the damper door can be engaged to the engagement edge to seal the damper door to the main body when the damper door is positioned in the closed position and the outer edge is disengaged from the damper door when the damper door is positioned in the open position.

In at least one example, the engagement edge of the main body is oriented on the inner surface such that the surface area of the outer edge engaged to the engagement edge gradually increases as the damper door is rotated from the open position into the closed position to gradually seal the damper door to the main body.

A ventilation assembly, in an example, a main housing defining an interior space and having an inlet opening and an outlet opening. The ventilation assembly can also include a fan assembly positionable within the interior space and including a fan operable to draw fluid into the inlet opening and out of the outlet opening and a damper assembly positioned at the outlet opening. The damper assembly can include a main body defining an inner surface and a continuous fluid path extending between a first opening and a second opening. The main body can include an engagement edge extending circumferentially on the inner surface, the first opening positioned to receive fluid from the outlet opening. The damper assembly can also include a damper door having an outer edge and rotatably mounted to the inner surface of the main body such that the damper door is rotatable relative to the main body between at least an open position and a closed position. A predetermined surface area of the outer edge of the damper door can be engaged to the engagement edge to seal the damper door to the main body when the damper door is positioned in the closed position and the outer edge is disengaged from the damper door when the damper door is positioned in the open position.

A method of preventing backflow in a ventilation assembly, in an example, can include positioning a first opening of a main body adjacent an outlet opening of a main housing of a ventilation assembly, the main body including a second opening and defining an inner surface having an engagement edge. The method can also include mounting a damper body to the inner surface of the main body, the damper door having an outer edge. The method can also include rotating the damper door into an open position in which the outer edge of the damper body is disengaged from the engagement edge and rotating the damper door into a closed position in which the outer edge of the damper door engages a predetermined surface area of the engagement edge. In at least one example, the engaged surface area between the outer edge of the damper door and the engagement edge of the main body gradually increases as the damper door is rotated into the closed position.

This overview is intended to provide an overview of subject matter of the present patent application. It is not intended to provide an exclusive or exhaustive explanation of the present subject matter. The detailed description is included to provide further information about the present patent application.

BRIEF DESCRIPTION OF THE DRAWINGS

In the drawings, which are not necessarily drawn to scale, like numerals can describe similar components in different views. Like numerals having different letter suffixes can represent different instances of similar components. The drawings illustrate generally, by way of example, but not by way of limitation, various embodiments discussed in the present document.

FIG. 8 is tables including exhaust fan operational parameters comparing data for conventional damper doors with one example of the damper door according to an example of the present disclosure.

DETAILED DESCRIPTION

Figure 1:
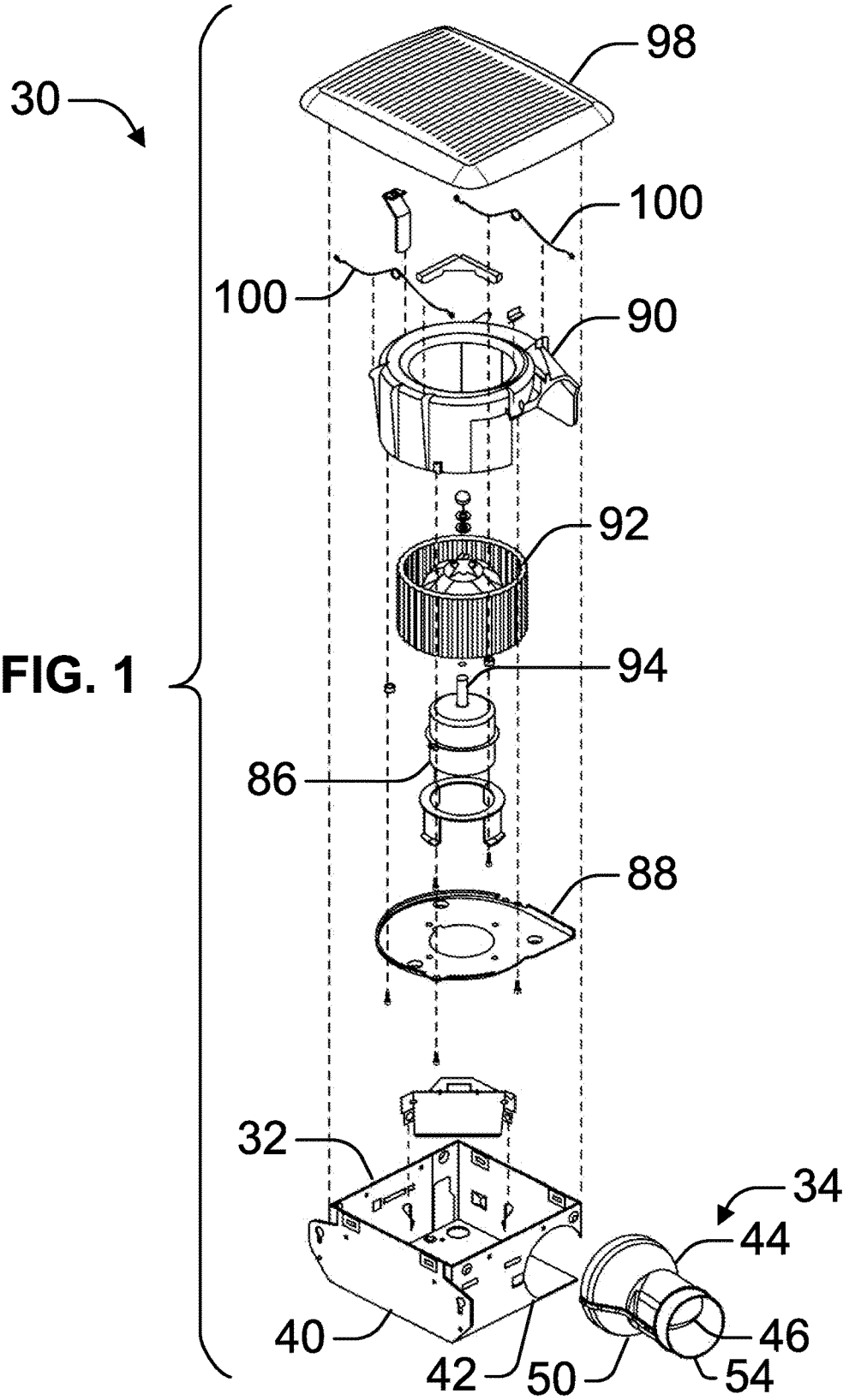
FIG. 1 shows an exploded view of a ventilation assembly according to an example of the present disclosure.
Figure 4A:
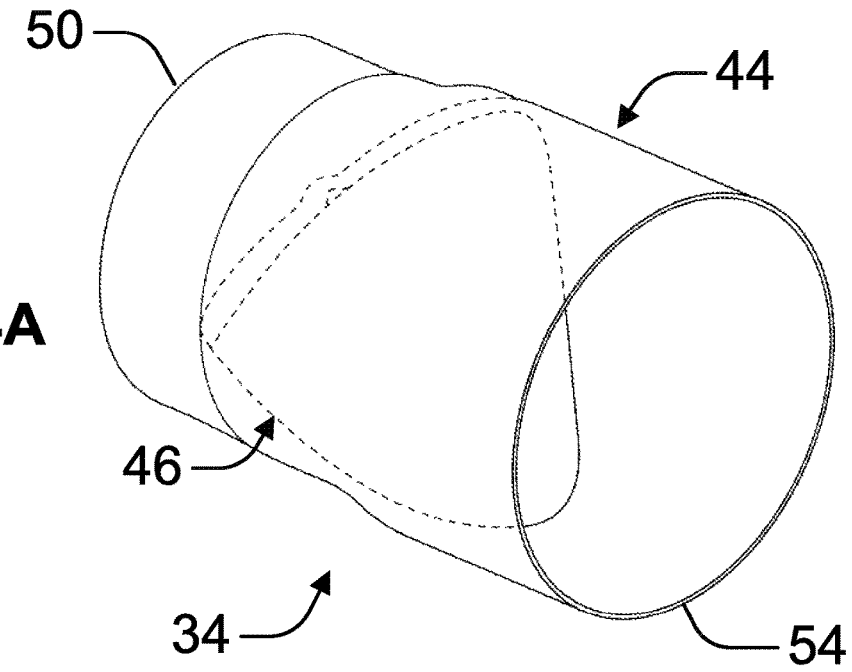
FIG. 4A is a partial cross-sectional view of a damper assembly with a damper door positioned in a closed position according to an example of the present disclosure.
Figure 4B:
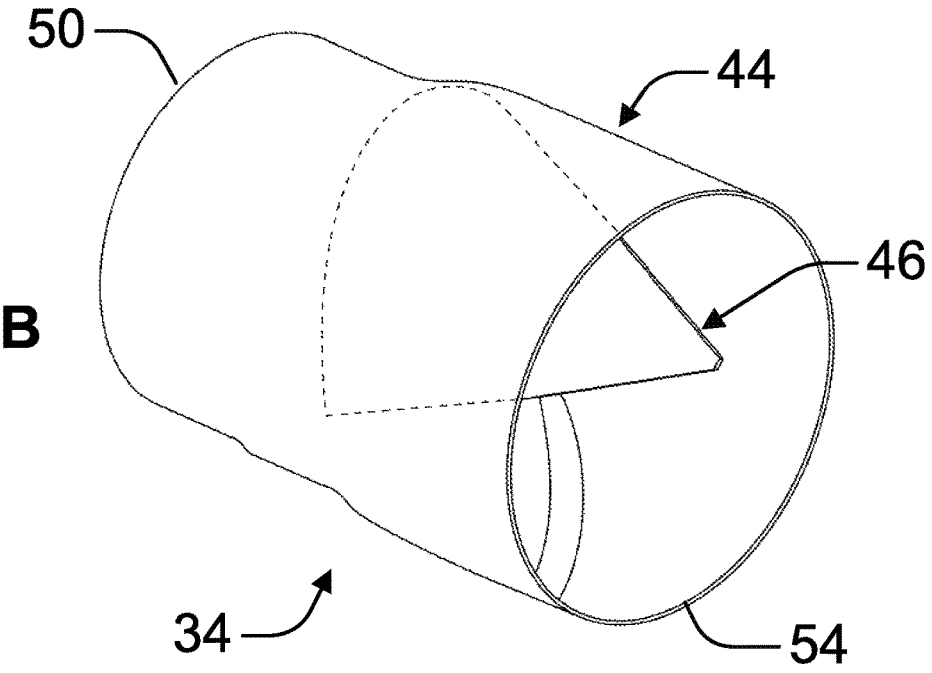
FIG. 4B is a partial cross-sectional view of a damper assembly with a damper door positioned in a partially-closed position according to an example of the present disclosure.

As depicted in FIG. 1, a ventilation assembly 30, according to an example, can include a main housing 32, a damper assembly 34 and a fan assembly 36. The main housing 32 can include a housing wall 38 defining an interior space and can include at least an inlet opening 40 and an outlet opening 42. The fan assembly 36 can be positioned in the interior space and operable to create an inlet airflow through the inlet opening 40 and an outlet airflow through the outlet opening 42. As depicted in FIGS. 4A-4C, the damper assembly 34 can include a main body 44 and a damper door 46 rotatable within the main body 44 between at least an open position and a closed position. The main body 44 can be positioned at the outlet opening 42 and comprise a tubular shape having an opening for directing the outlet airflow exiting the outlet opening 42. In the open position, the damper door 46 is rotated to position the damper door 46 within the main body 44 to permit air flow through the opening. In the closed position, damper door 46 substantially obstructs the opening of the main body 44 to prevent the back flow of air into the main housing 32 through the outlet opening 42. In an example, the main body 44 and damper door 46 can be configured to reduce the noise generated or reflected by the damper door 46 during operation of the fan assembly 36.

Figure 2A:
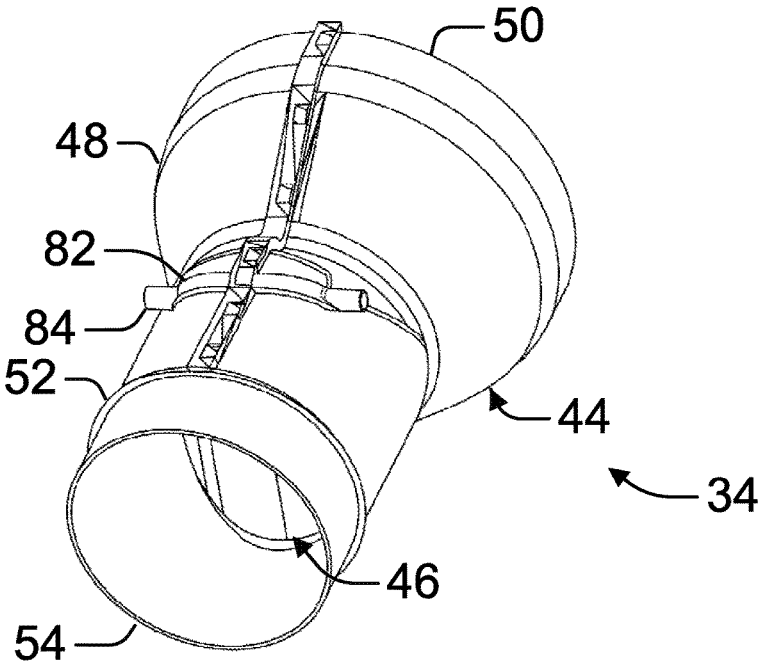
FIG. 2A illustrates a perspective view of a damper assembly with a damper door positioned in a closed position according to an example of the present disclosure.
Figure 2B:
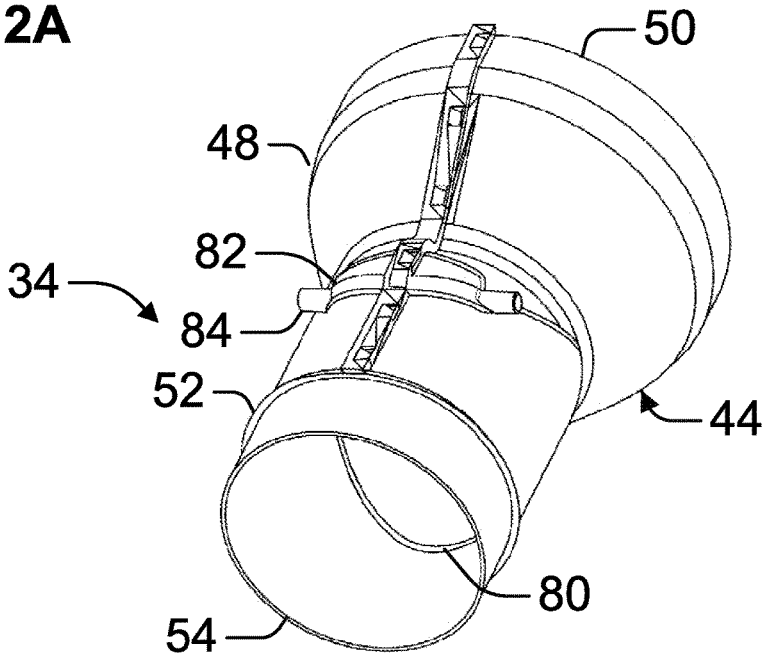
FIG. 2B illustrates a perspective view of a damper assembly with a damper door positioned in an open position according to an example of the present disclosure.
Figure 2C:
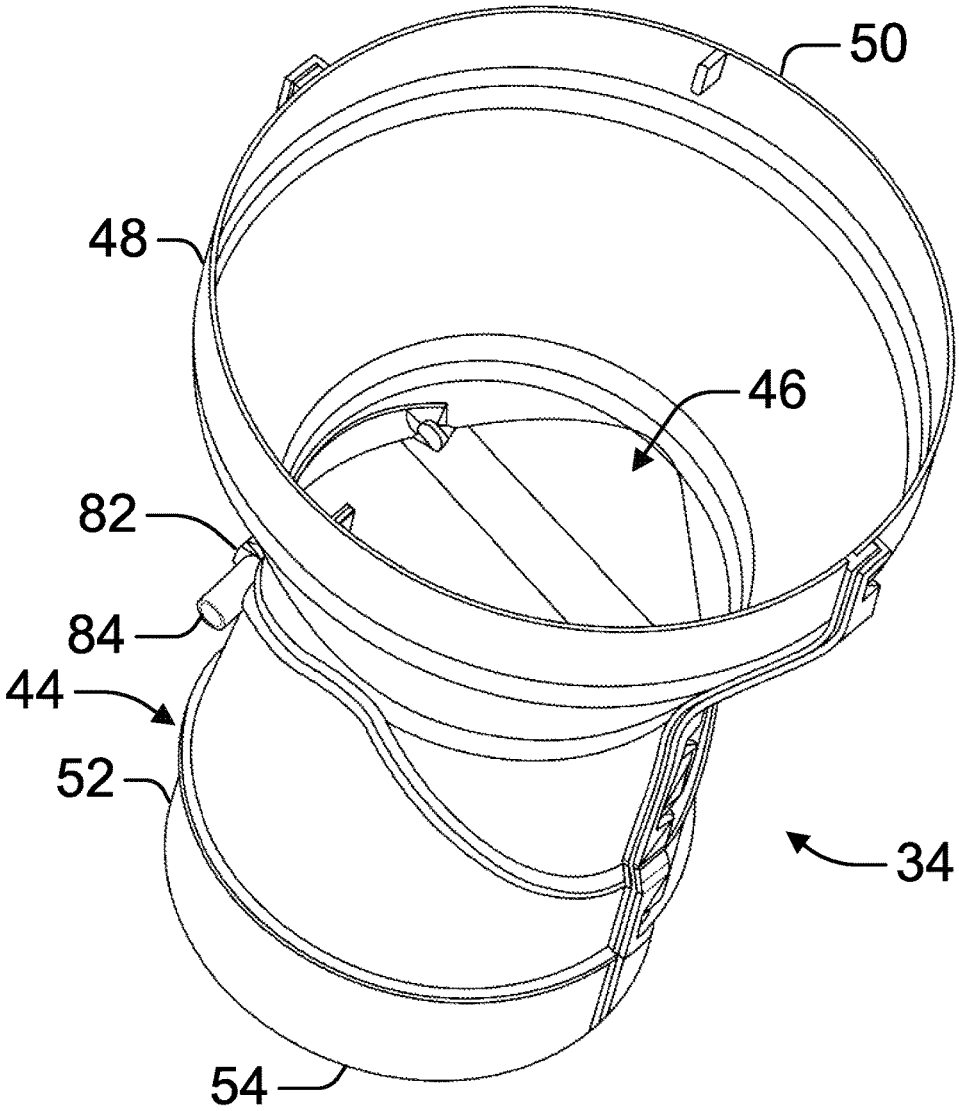
FIG. 2C is a rear perspective view of a damper assembly with a damper door positioned in a closed position according to an example of the present disclosure.
Figure 2D:
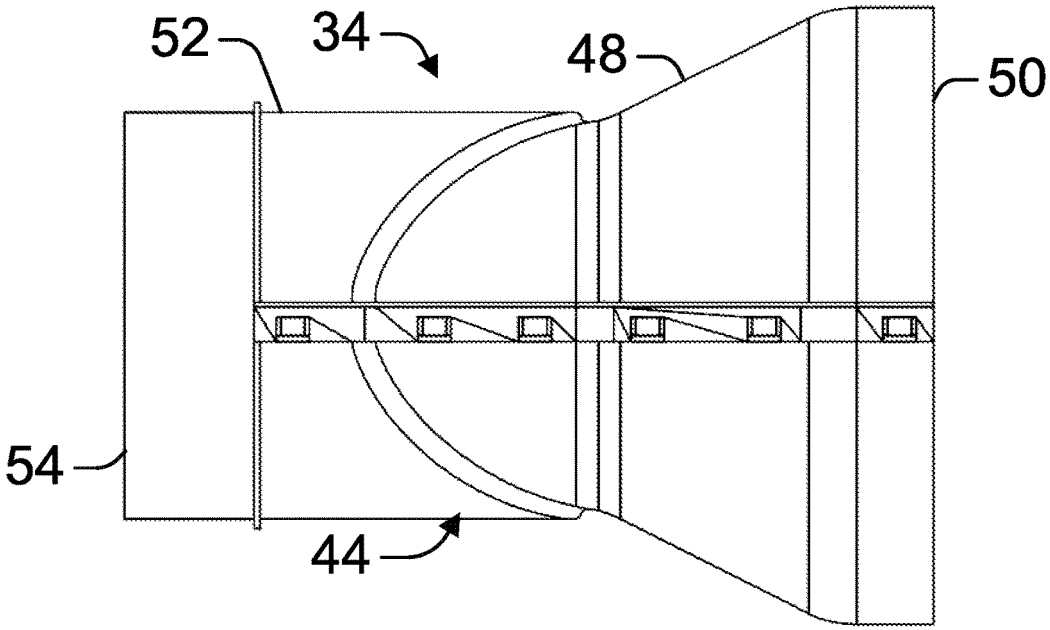
FIG. 2D is a bottom view of a first body portion of a main body of a damper assembly according to an example of the present disclosure.
Figure 2E:
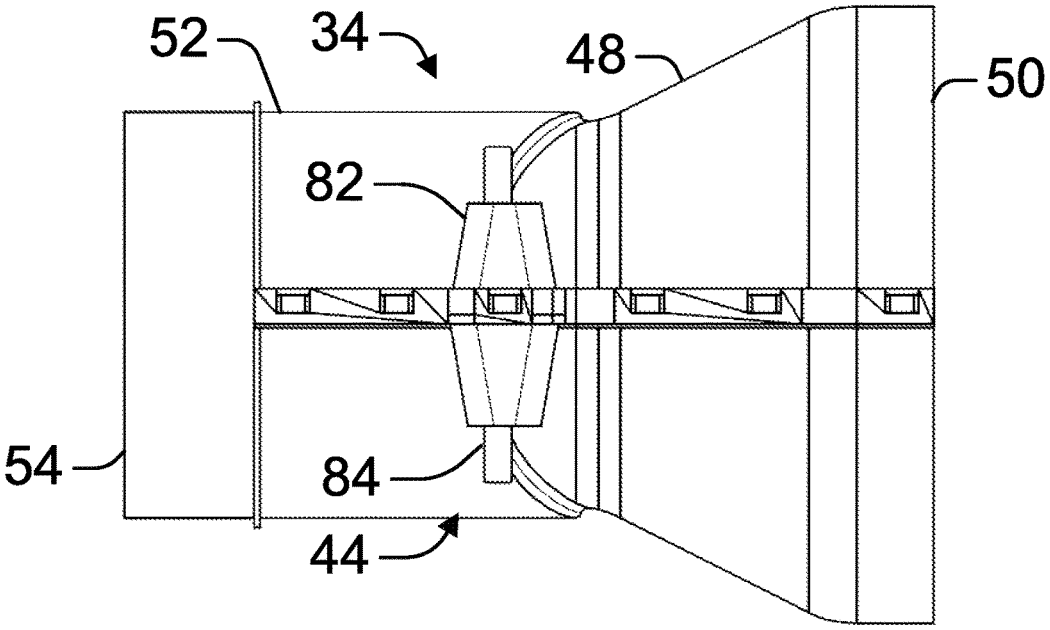
FIG. 2E is a top view of a second body portion of a main body of a damper assembly according to an example of the present disclosure.
Figure 2F:
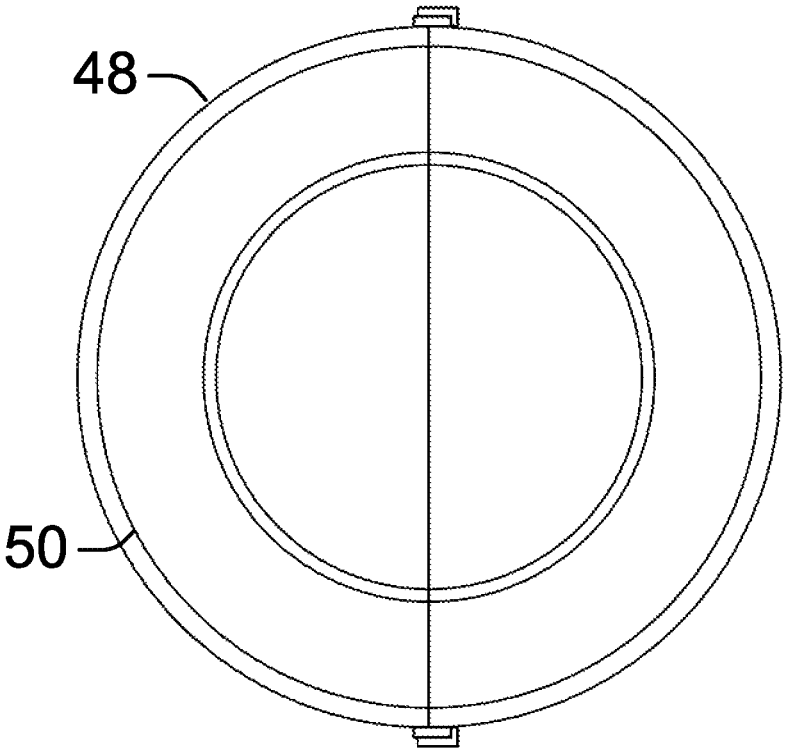
FIG. 2F is a bottom view of a first body portion of a main body of a damper assembly according to an example of the present disclosure.
Figure 2G:
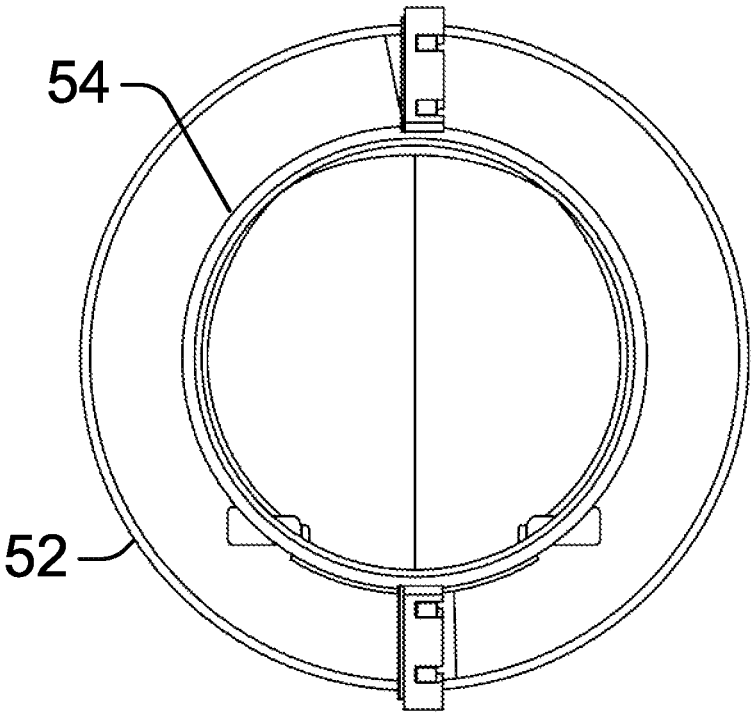
FIG. 2G is a top view of a second body portion of a main body of a damper assembly according to an example of the present disclosure.

As depicted in FIGS. 2A-G, in an example, the main body 44 of the damper assembly 34 can include a first region 48 defining a first opening 50 and also include a second region 52 defining a second opening 54. The first region 48 can be operably coupled to the second region 52 to define an inner surface 56 extending between the first opening 50 and the second opening 54. In at least one example, the main body 44 can comprise a substantially tubular-shape or pipe-shape such that the inner surface 56 comprises a substantially curved or tubular shape, as depicted in FIGS. 2A-C. In at least one example, the first region 48 and the second region 52 can have different cross-sectional shapes to correspond to the shape of first opening 50 or ductwork. The main body 44 at first region 48 and the second region 52 can each comprise a cross-sectional shape of substantially rectangular, square, circular, triangular, octagonal, other polygonal shapes. In at least one example, the main body 44 can comprise a first cross-sectional shape at the first region 48 and a second cross-sectional shape at the second region 52.

Figure 5A:
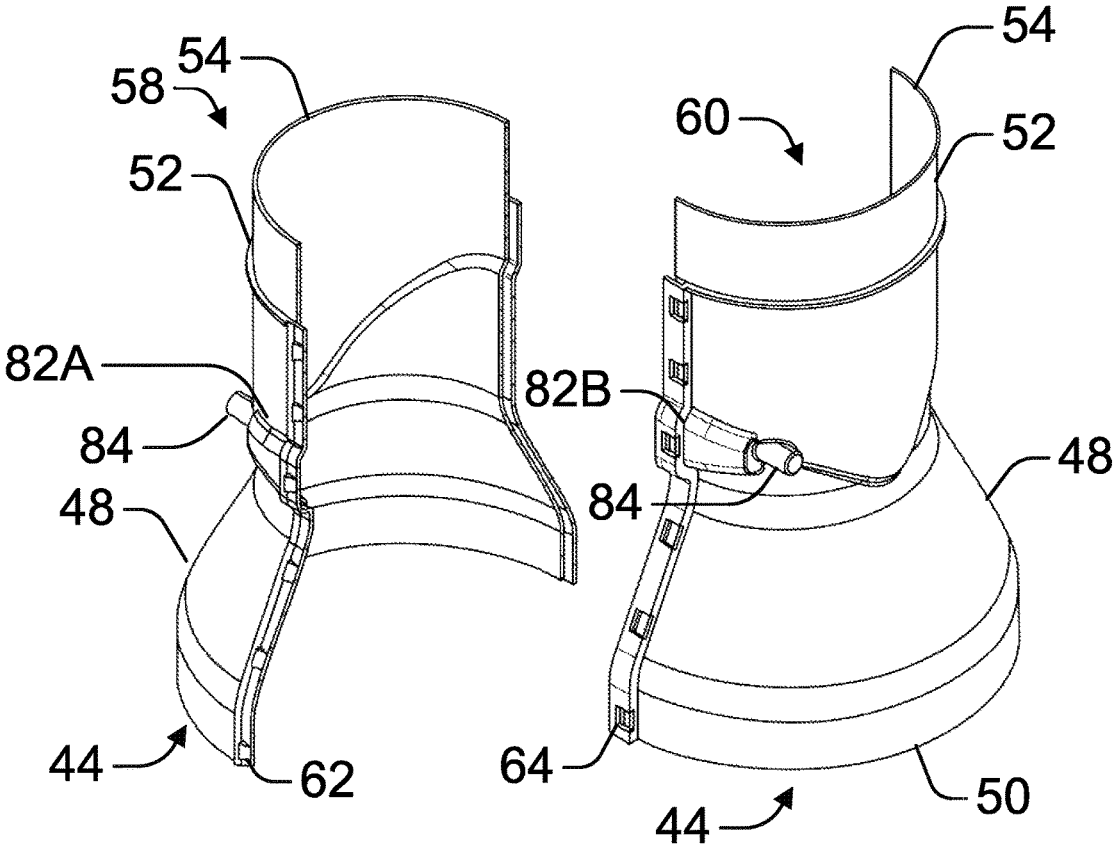
FIG. 5A is an exploded perspective view of a first body portion and a second body portion of a main body according to an example of a present disclosure.
Figure 5B:
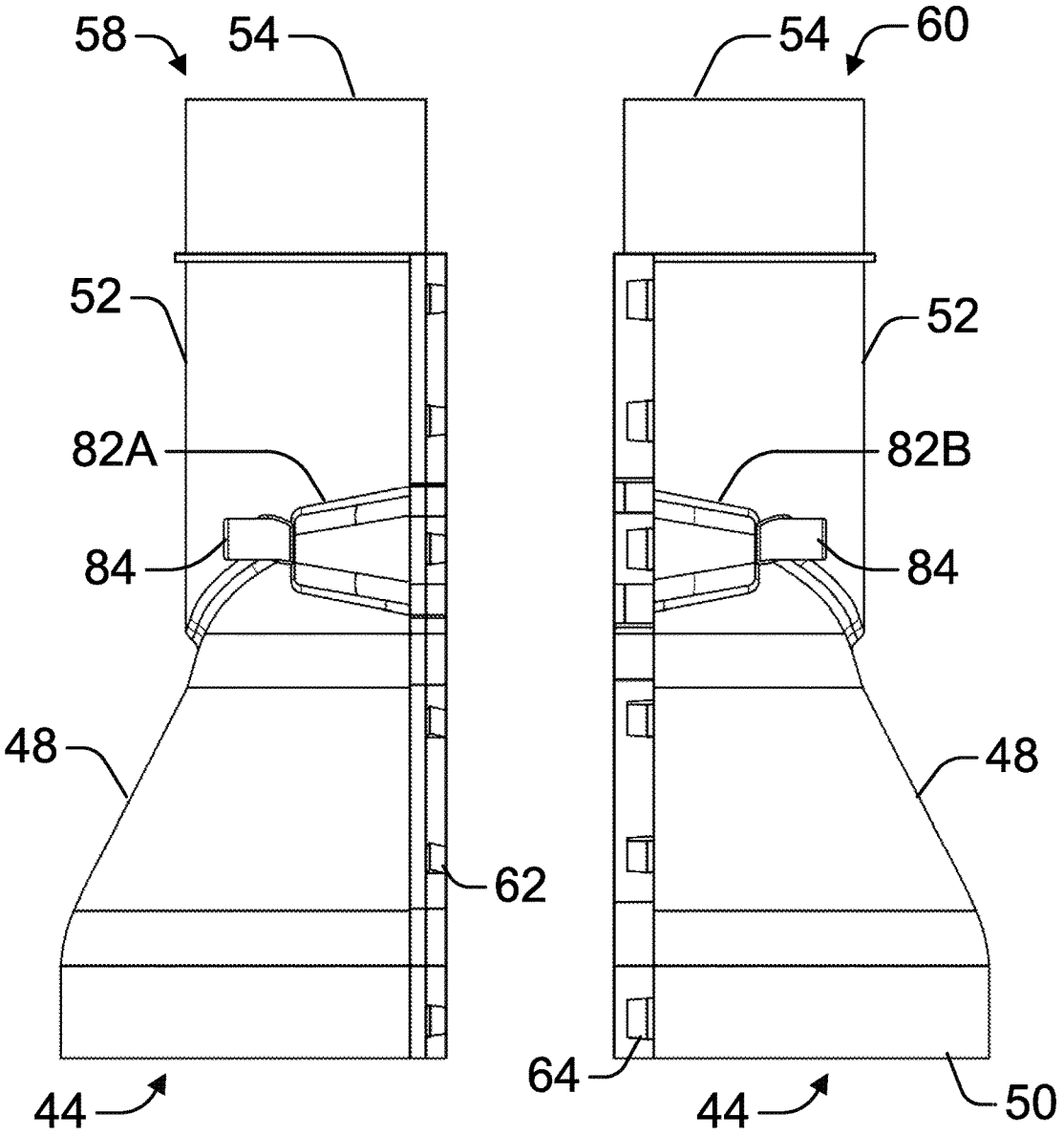
FIG. 5B is an exploded top view of a first body portion and a second body portion of a main body according to an example of a present disclosure.
Figure 5C:
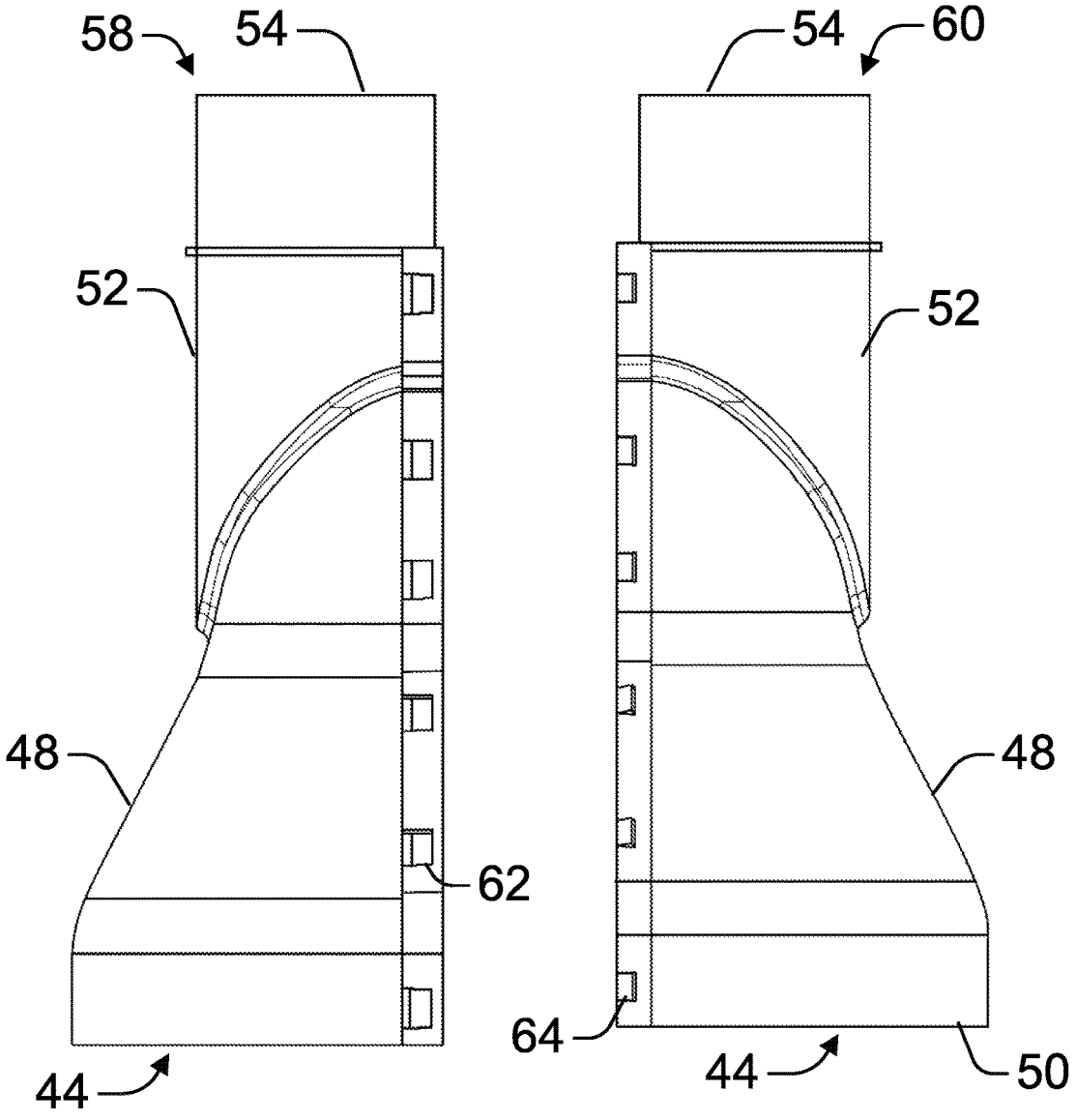
FIG. 5C is an exploded top view of a first body portion and a second body portion of a main body according to an example of a present disclosure.
Figure 5D:
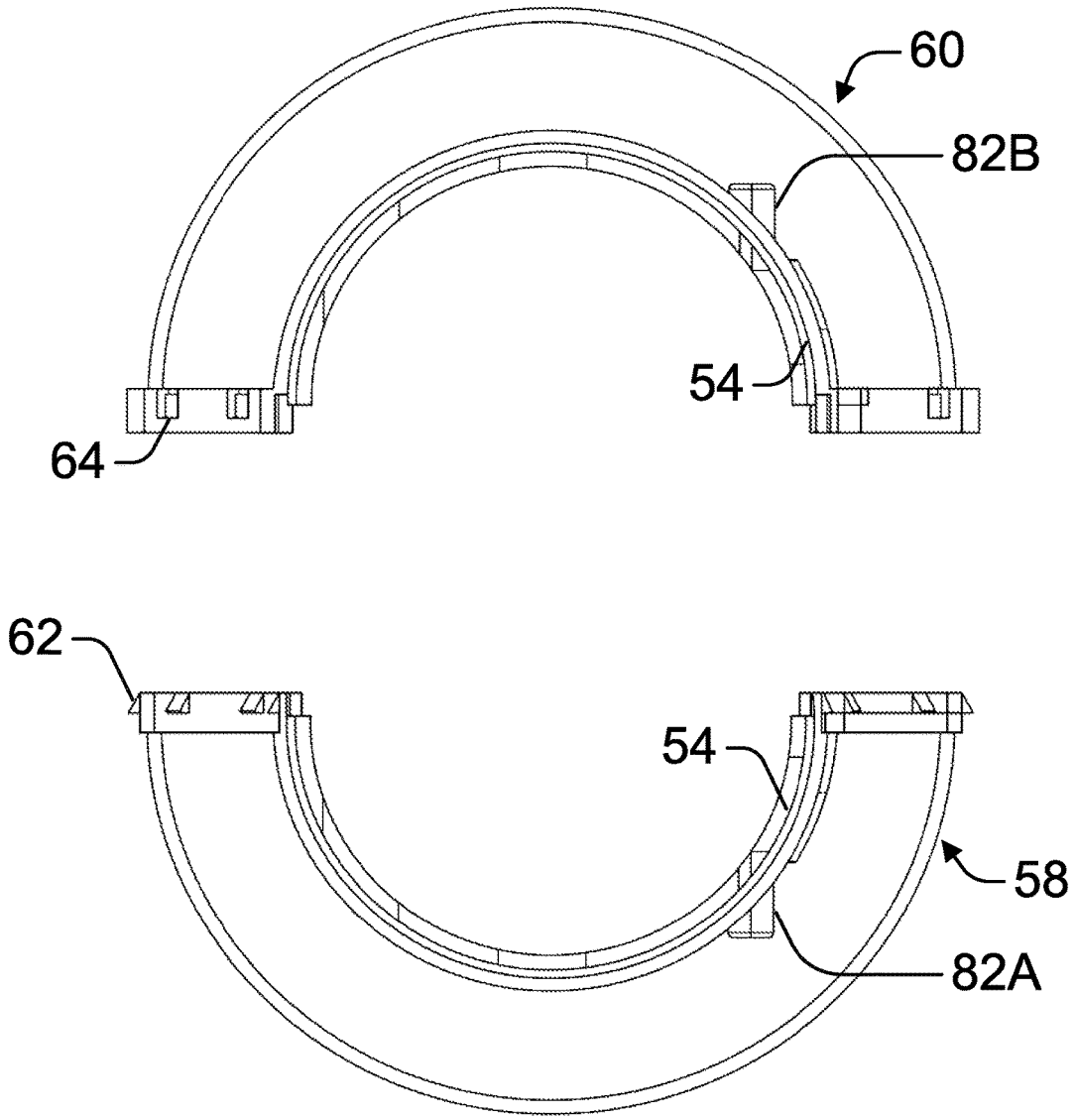
FIG. 5D is an exploded rear view of a first body portion and a second body portion of a main body according to an example of a present disclosure.
Figure 5E:
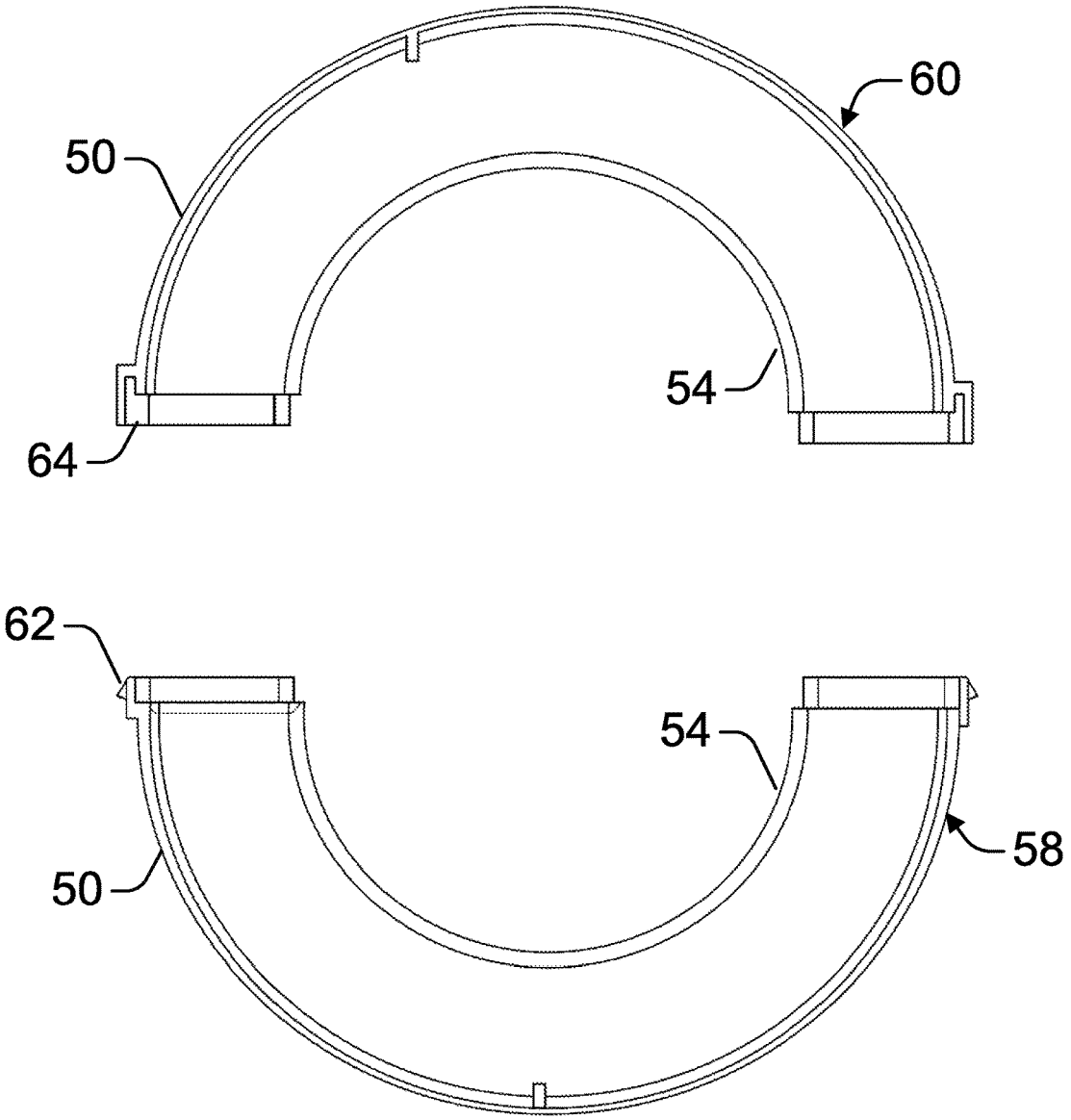
FIG. 5E is an exploded rear view of a first body portion and a second body portion of a main body according to an example of a present disclosure.

As depicted in FIGS. 5A-5E, in an example, the main body 44 can include at least a first body portion 58 configured to couple a second body portion 60 to assembly the main body 44. The first body portion 58 corresponds to the first region 48 and the second body portion 60 corresponds to the second region 52, such that coupling the first body portion 58 to the second body portion 60 defines a continuous inner surface 56 between the first opening 50 and the second opening 54. In at least one example, the first body portion 58 includes a plurality of tabs 62 and the second body portion 60 defines a plurality of slots 64 each corresponding to at least one of the tabs 62 as depicted in FIGS. 5A-5C. The tabs 62 of the first body portion 58 are insertable to the slots 64 of the second body portion 60 to engage the first body portion 58 to the second body portion 60. In at least one example, the tabs 62 can be positioned adjacent an inner edge of the first body portion 58 and the slots 64 can be positioned adjacent an inner edge of the second body portion 60. The tabs 62 can extend along some portion of the longitudinal length of the first body portion 58 and the slots 64 can extend along some portion of the longitudinal length of the second body portion 60.

Figure 6A:
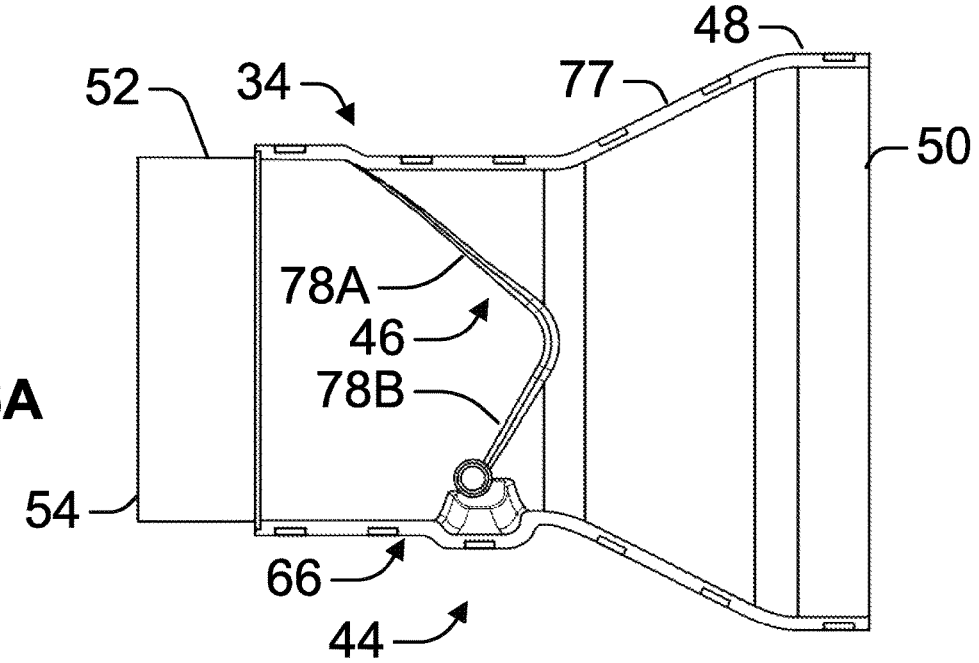
FIG. 6A is a cross-sectional side view of a damper assembly according to an example of the present disclosure.
Figure 6B:
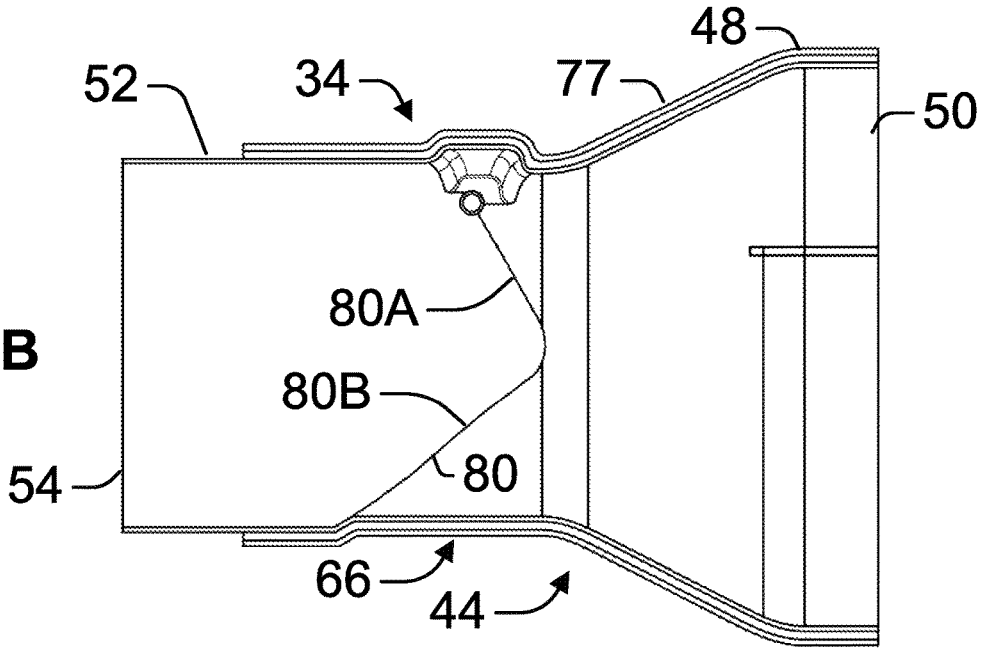
FIG. 6B is a cross-sectional side view of a main body according to an example of the present disclosure.

As depicted in FIGS. 6A-6B, in an example, the main body 44 can include a transition region 66 positioned between the first region 48 and the second region 52. The transition region 66 can cooperate with the first region 48 and the second region 52 to define a continuous inner surface 56 between the first opening 50 and the second opening 54. The inner surface 56 corresponding to the transition region 66 can comprise a plurality of surfaces.

As depicted in FIGS. 6A-6B, in at least one example, the main body 44 at the first region 48 can have a first diameter and the main body 44 at the second region 52 can have a second diameter. In this configuration, the second diameter can correspond to the diameter of ductwork for interfacing with the second opening 54. Similarly, the first diameter can correspond to the diameter of the outlet opening 42 for interfacing with the first opening 50. In at least one example, the first diameter can be less than about 6 inches and the second diameter can be less than about 4 inches. In at least one example, the diameters of the first diameter and the second diameter can be substantially equal.

In at least one example, the transition region 66 can be shaped to comprise a substantially continuously graduated diameter between the first diameter of the first region 48 and the second diameter of the second region 52. The diameter of the transition region 66 can vary continuously or discontinuously between the first region 48 and the second region 52. In at least one example, the transition region 66 can be shaped to comprise a beveled edge 51 extending around the inner surface 56 to define a sloped surface between the first diameter of the first region 48 and the second diameter of the second region 52. The slope of the beveled edge 51 can be varied to accommodate the position of the damper door 46 in the closed position. In an example, at least a portion of the damper door 46 engages a portion of the inner surface 56 at the transition region 66 and prevents rotation of the damper door past the closed position.

As depicted in FIGS. 6A-6B, in an example, the main body 44 can include a plurality of regions of varying shapes and diameters coupled to form a substantially smooth fluid flow between the first opening 48 and the second opening 52. In an example, the main body can include a waist region 68 coupling the transition region 66 to a flared region 70. The flared region 70 can comprise a generally conically shaped including a variable diameter extending from a first diameter at a first end coupled to the waist region 68 and a continuously graded diameter extending to a second end coupled to a junction 72. In at least one example, the junction 72 can include a generally convex outer surface and a generally concave inner surface forming a transition between the second end of the flared region 70 and an exit region 74. The exit region 74 can be substantially parallel with the radius of the main body 44.

In an example, the damper assembly 34 can comprise a sheet metal, including, but not limited to an aluminum-based metal, a steel or iron-based metal, a zinc-based metal, or a nickel and tin-based metal. In another example, the damper assembly 34 can comprise a polymer or mixtures of polymers. In at least one example, the damper assembly 34 can comprise injection molded polymers, thermo-formed polymers, thermosetting polymers, or any other suitable material. In at least one example, the damper assembly 34 can comprise three dimensionally printed materials including, but not limited to polymers, including thermo-formable polymers, thermosetting polymers, polymer composites, glass and ceramic compositions, wood or fiber-based materials, or any other suitable material that can be three dimensionally printed.

As depicted in FIGS. 4A-4C, in an example, the damper door 46 can be moved within the main body 44 between at least the closed position and the open position to control a flow of fluid through the main body 44. The damper door 46 can include a damper body 76 defining an outer edge 78 engagable to the inner surface 56 of the main body 44 in the closed position to regulate the flow of fluid through the main body 44. In at least one example, the damper body 76 is shaped to substantially obstruct the fluid path through the main body 44 to substantially restrict the flow of fluid through the main body 44. In at least one example, the damper body 76 is shaped to partially obstruct the fluid path through the main body 44 when the damper door 46 is positioned in the closed position. The damper door 46 can be moved from the closed position to a partially closed position to vary the obstruction of the fluid path by the damper body 76 to provide a variable flow path through the main body 44.

Figure 3A:
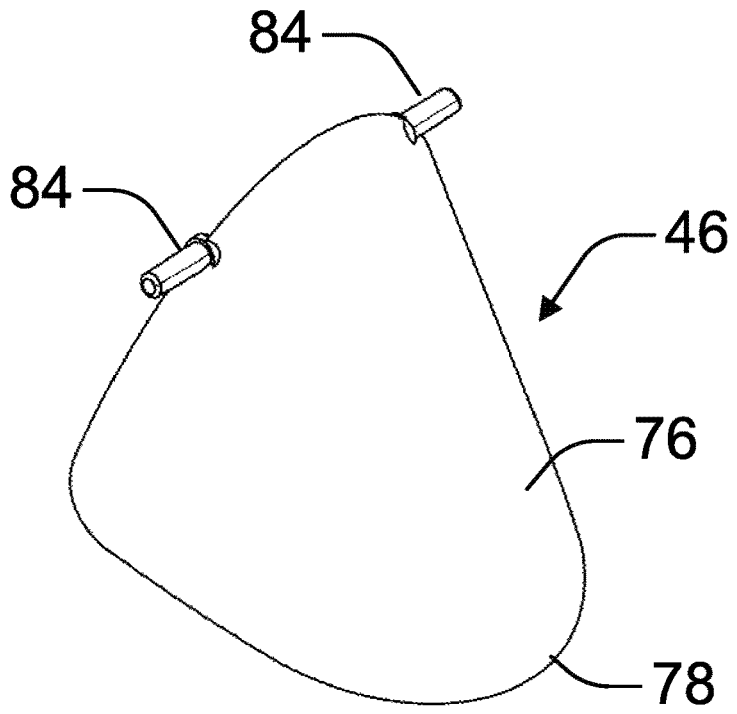
FIG. 3A is a front perspective view of a damper door of a damper assembly according to an example of the present disclosure.
Figure 3B:
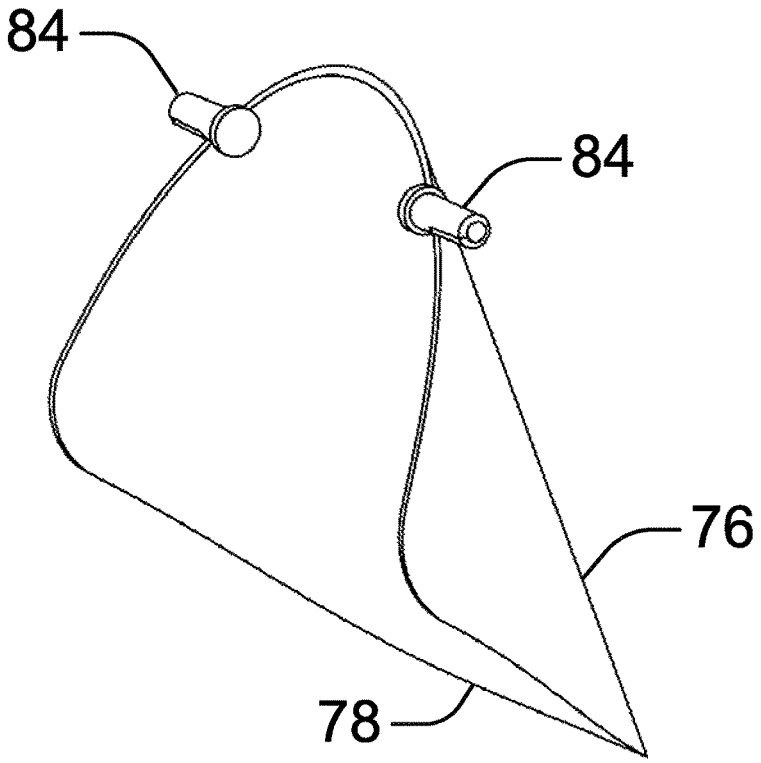
FIG. 3B is a rear perspective view of a damper door of the damper assembly according to an example of the present disclosure.
Figure 3C:
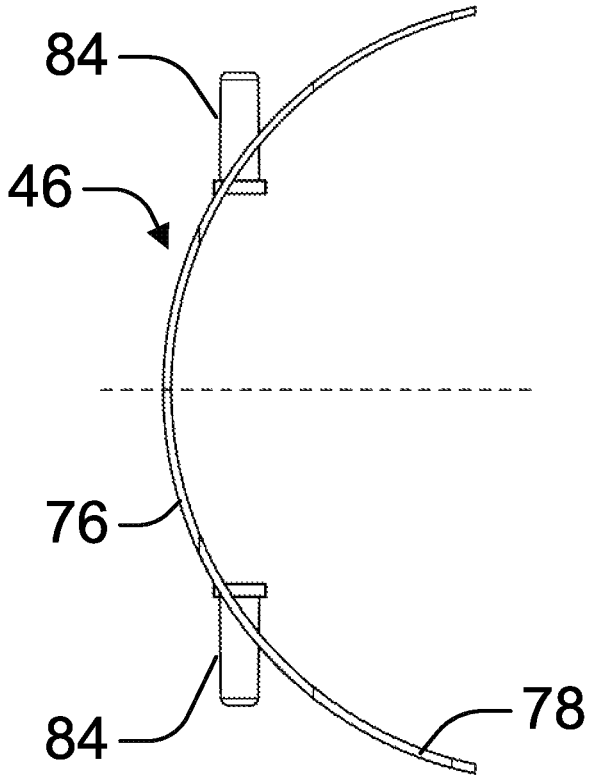
FIG. 3C is a cross-sectional view of a damper door of a damper assembly according to an example of the present disclosure.
Figure 3D:
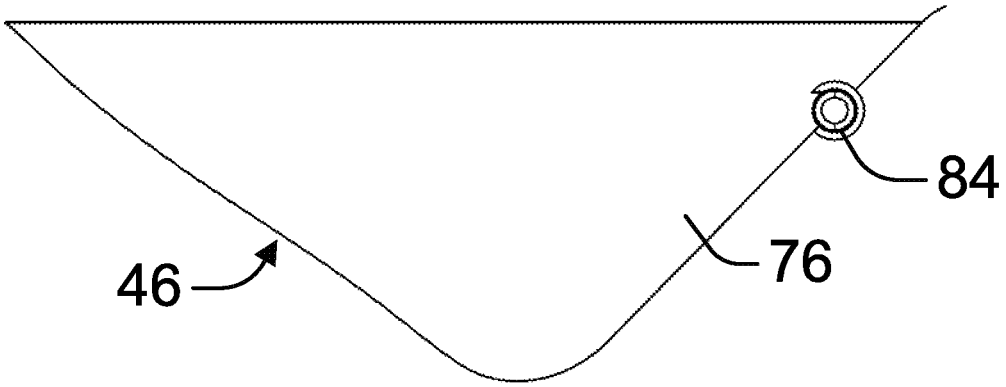
FIG. 3D is a side view of a damper door of a damper assembly according to an example of the present disclosure.
Figure 3E:
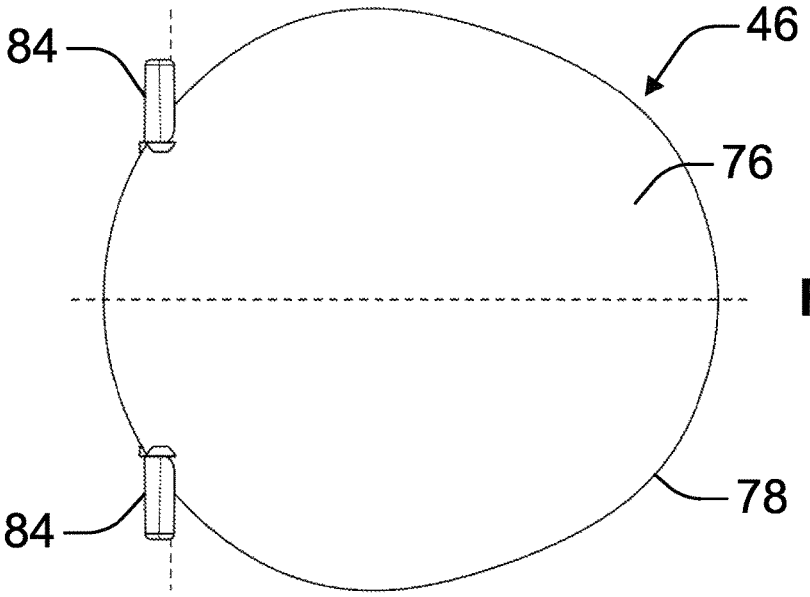
FIG. 3E is a top view of a damper door of a damper assembly according to an example of the present disclosure.
Figure 3F:
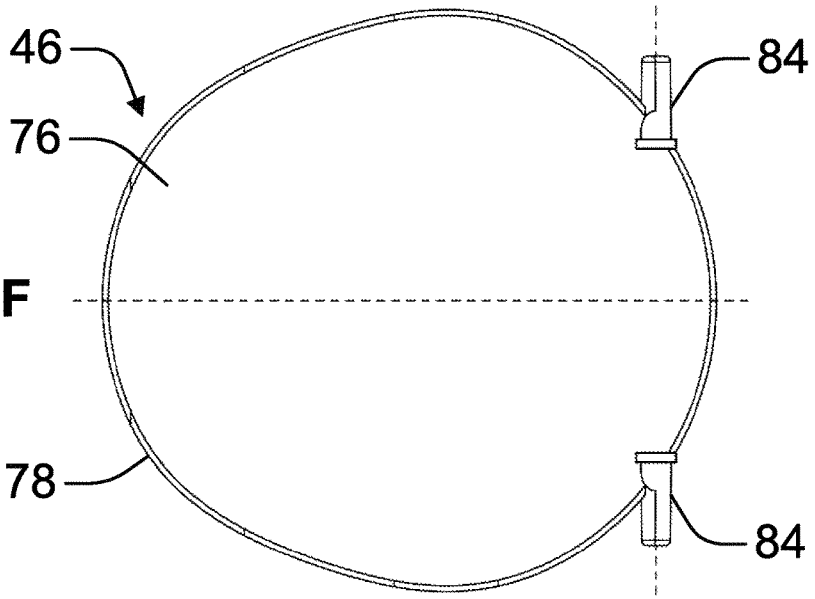
FIG. 3F is a bottom view of a damper door of a damper assembly according to an example of the present disclosure.

In an example, the main body 44 can comprise a substantially circular cross-section. As depicted in FIGS. 3A-F, the damper body 76 can be generally curved (i.e. includes at least one concave surface and convex surface) to correspond to the shape of the inner surface 56 of the main body 44. The damper body 76 can be mirrored about a center axis (as depicted in FIG. 3C). In at least one example, the outer edge 78 can be curved to comprise an outer arc that substantially approximates to the substantially curved cross-section of the inner surface 56 of the main body 44. In at least one example, the main body 44 can define an engagement edge 80 positioned to engage the outer edge 78 of the damper body 76 when the damper door 46 is rotated into the closed position. One example, the beveled edge 51 constitutes the engagement edge 80.

As depicted in FIGS. 2A-2C and 2E, in at least one example, the main body 44 can include at least one coupler 82 positioned within the inner surface 56. As depicted in FIGS. 3A-3D, in an example, the damper door 46 can include at least one attachment pin 84 extending from an upper surface of the damper body 76. Each coupler 82 defines a receptacle for receiving the pin 84 permitting the attachment pin 84 to rotate within the couplers 82. In an example, the attachment pin 84 can define a rotational axis such that the damper door 46 is rotatable about the rotational axis relative to the main body 44 between the open position and the closed position. In at least one example, the damper door 46 can be rotatably coupled to the main body 44 using other couplers, including, but not limited to conventional clips, screws, rivets, rods, and drives. The length and diameter of each pin 84 can be varied to correspond to the dimensions of the coupler 82. In an example, the coupler 82 can include a biasing element that biases the damper door 46 into the closed position. The biasing element can include, but is not limited to a leaf spring, a flat spring, a coil spring, elastic member or other element for biasing the damper door 46 into the closed position. In at least one example, the damper body 76 can include a pair of attachment pins 84 arranged to align with the rotational axis. In this configuration, the main body 44 can include a pair of couplers 82 each corresponding to at least one of the pins 84.

As depicted in FIGS. 2A-2C, in an example, the damper door 46 can be coupled to the main body 44 by coupling each attachment pin 84 with the corresponding coupler 82. For example, in at least one example, each coupler 82 can each comprise a receptacle that are sized to at least partially accept an inserted attachment pin 84, and can include the rotational axis when each attachment pin 84 are coupled. In at least one example, by coupling each attachment pin 84 to the corresponding coupler 82 and assembling the separable body portions 58, 60 of the main body 44 enclosing the coupled damper door 46. The separable body portions 58, 60 can be coupled together using the tabs 62 on the first body portion 58 that can interlock with the series of slots 64 on the second body portion 60 substantially enclosing the damper door 46. The assembled damper assembly 34 is depicted in FIGS. 2A-2C. As depicted in FIGS. 2A-2C and 5A, substantially all of the couplers 82 can be located outside of the inner surface 56 of the main body 44.

In an example, the damper door 46 can comprise a material that is substantially similar or substantially the same as the main body 44. The damper door 46 can be formed from a sheet metal, including, but not limited to an aluminum based metal, a steel or iron-based metal, a zinc-based metal, or a nickel and tin-based metal. In at least one example, the damper door 46 can comprise injection molded polymers, thermo-formed polymers, thermosetting polymers, or any other suitable material. In at least one example, the attachment pins 84 can comprise a material that is substantially similar or substantially the same as the main body 44. In at least one example, each attachment pins 84 can be integrated with the main body 44. For example, in certain examples, each attachment pins 84 can be molded integrally with main body 44. In at least one example, each attachment pin 84 can be coupled to the main body 44 following manufacture of the main body 44.

Figure 4D:
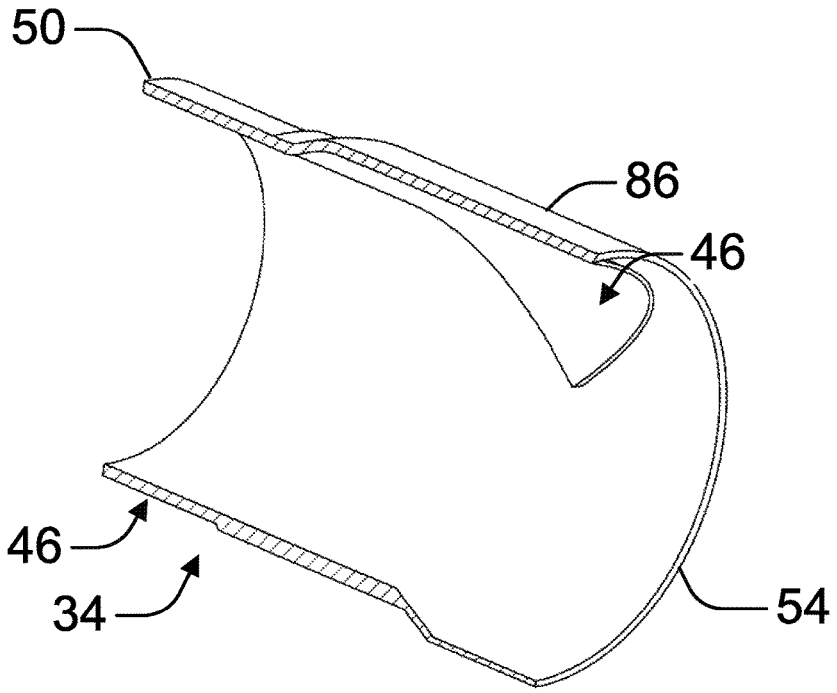
FIG. 4D is a partial cross-sectional view of a damper assembly with a damper door positioned in an open position within a clearance region of a main body according to an example of the present disclosure.
Figure 4C:
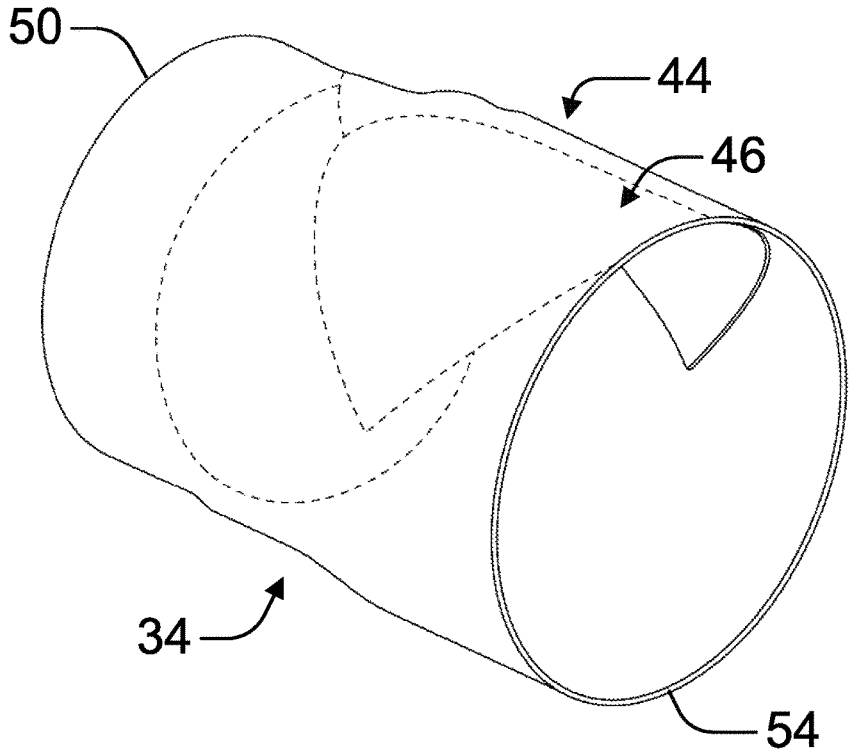
FIG. 4C is a partial cross-sectional view of a damper assembly with a damper door positioned in an open position according to an example of the present disclosure.

As depicted in FIG. 4D, in an example, the main body 44 can include a damper door clearance region 86 for receiving the damper door 46 when the damper door 46 is rotated about the rotational axis into the open position. For example, in at least one example, the clearance region 86 is shaped to accommodate pivoting of the damper door 46 from a closed position (shown in FIG. 4A) to a partially open position (FIG. 4B), and from the closed or partially open position to the open position (FIG. 4C-D). The clearance region 86 can be positioned within the inner surface 56 in at least one example. In at least one example, the clearance region 86 can positioned within the transition region 66 of the main body 44, wherein the main body 44 extends as a bulge extending outwardly to provide greater height of the inner volume adjacent to the outer surface of the damper body 76 of the damper door 46. In one example, the beveled edge 51 creates the outwardly extending bulge such that the diameter of the inner surface 56 closer to the second region 52 from the beveled edge 51 is larger than the diameter of the inner surface 56 closer to the first region 48 from the beveled edge 51. In at least one example, the clearance region 86 can extend can extend from the region generally adjacent to a first door coupler 82A of the pair of the door couplers 82, substantially following the radius of curvature of the main body 44 to the region adjacent to the second door coupler 82B of the pair of the door couplers 82. In another example, substantially all of the damper door body 76 opens into the clearance region in the open position, The shape and radius of curvature of the clearance region inner surface of the clearance region 86 can enable the damper door 46 to rotate within the main body 44 about the rotational axis so that at least a portion of the damper body 76 can rotate within the main body 44 through an arc that includes the radius of curvature of the inner surface of the clearance region 86. In at least one example, the damper body 76 can rotate within the main body 44 and shaped to follow the radius of curvature of the inner surface of the clearance region 86 including a certain gap between the main body 44 and the inner surface of the clearance region 86.

As depicted in FIGS. 4C-4D, in an example, the gap (i.e. a "clearance gap") between the damper body 76 of the damper door 46 and the inner surface of the clearance region 86 of the main body 44 can be substantially constant as the damper door 46 rotates and the upper surface of the damper body 76 passes across the width of the inner surface of the clearance region 86. In at least one example, the gap between the upper surface of the damper body 76 and the inner surface of the clearance region 86 can vary as the upper surface of the damper body 76 and passes across the width of the inner surface of the clearance region 86. In certain examples, the upper surface of the damper body 76 can rotate within the main body 44 following the radius of curvature of the inner surface of the clearance region 86 while being at least partially coupled to the inner surface of the clearance region 86.

In an example, the clearance gap can be eliminated. The clearance gap can be substantially eliminated by decreasing the inner diameter of the upper transition region 66 adjacent to the clearance region 86 of the main body 44. The gap size and shape can be changed by varying the inner diameter of the upper transition region 66 defined by the main body 44 positioned adjacent to the first door coupler 82A and second door coupler 82B. In at least one example, the gap size and shape can be changed to account for varying tolerances of the damper assembly 34. For example, depending on the manufacturing tolerances of the damper door 46 and the main body 44 can be expanded or reduced by changing the inner diameter of the upper transition region 66 defined by the main body 44 positioned adjacent to the first door coupler 82A and second door coupler 82B. Back drafts can be reduced or substantially eliminated by reducing or substantially eliminating the clearance gap.

In an example, following a rotation from an open to a closed position, the damper door 46 can couple with the main body 44 at the transition region 66. The damper door 46 can couple with the main body 44 at a transition region 66 by coupling some regions of the outer edge 78 of the damper door 46 with some regions of the transition region 66 that comprise the junction 72. In this configuration, the engagement edge 80 can comprise a lower transition surface 80A and an upper transition surface 80B. Moreover, both the lower transition surface 80A and the upper transition surface 80B can include a substantially continuously graduated diameter. The damper body 76 can be shaped such that the outer edge 78 has a corresponding lower outer edge portion 78A and upper outer edge portion 78B for coupling with these regions. In this configuration, if the damper door 46 was previously in a partially or fully open position, the outer edge 78 of the damper door 46 will have completely traversed the arc that includes the radius of curvature of the inner surface of the clearance region 86. Further, the lower outer edge portion 78A of the damper door 46 can include a substantially continuously graduated diameter corresponding to and coupling with the lower transition surface 80A of the main body 44.

In at least one example, as the damper door 46 is moved from an open position to a partially closed position and/or to a completely closed position, the total surface area of the outer edge 78 coupling with the engagement edge 80 can increase. In at least one example, when the damper is partially closed, the lower outer edge portion 78A of the damper door 46 can be in contact with the lower transition surface 80A in areas closer to transition from the upper transition surface 80B. As the damper door 46 is further closed, a greater surface area of the outer edge 78 can couple with the engagement edge 80 until the damper door 46 is complete closed, at which point substantially all of the outer edge 78 is in contact with the engagement edge 80.

In an example, the damper door 46 closure defined at least in part by a gradually increasing surface area coupling between the outer edge 78 and the engagement edge 80 can reduce vibration and/or noise emitted from the damper assembly 34. In this instance, when vibration and/or noise emission can be caused by contact of the damper door 46 with the main body 44, the graduated sealing of the damper door 46 with the outer edge 78 as described can substantially reduce the peak volume of the emitted noise and/or reduce vibration.

As depicted in FIG. 1, in an example, the fan assembly 36 can be positioned within the main housing 32 and operable to draw fluid through the inlet opening 40 and push fluid through the outlet opening 42. The damper assembly 34 can be positioned at the outlet opening 42 to regulate the flow of fluid through the outlet opening 42. The fan assembly 36 can include a motor 86 capable of being coupled to a motor mounting plate 88 nestled within a scroll 90, and coupled to a blower wheel 92. The blower wheel 92 can be mechanically coupled to the motor 86 using a main drive bolt 94. The motor 86 can be any motor capable of providing sufficient rotational torque to turn the blower wheel 92 at desired rotational speeds. In at least one example, when a conventional permanent split capacitor type motor is used, the motor 86 can be electrically coupled to at least one conventional permanent split capacitor. The fan assembly 36 can comprise a centripetal fan, bladed fan or other conventional fans selectively driven by a motor apparatus. In operation, the blower wheel 92 is rotated to draw fluid through the inlet opening 40 of the main housing 32 into the blow wheel 92. The fluid is then expelled out of the blower wheel 92 against the scroll 90, which directs the fluid out of the main housing 32 through the outlet opening 42.

In an example, the main housing 32 can form a base or a similar support structure of the damper assembly 34. Furthermore, in at least one example, the main housing 32 can provide conventional points and areas of attachment for the damper assembly 34 or other components of the assembly 10. The damper assembly 34 can be coupled to the fan assembly 36 by coupling to a region of the main housing 32 adjacent to the outlet opening 42 and/or by coupling onto the outlet opening 42. In at least one example, the damper assembly 34 can be coupled to the fan assembly 36 by coupling the first region 48 and the first opening 50 to a conventional duct connector and/or duct connector extension that is coupled to the main housing 32 and outlet opening 42. In at least one example, the second region 52 and the second opening 54 can be coupled to a conventional duct and/or duct extension (not shown).

In an example, the ventilation assembly 30 can be used to ventilate any room, area or space. The ventilation assembly 30 can be secured within a wall, ceiling, or other building structure in a partially, or fully recessed position. The ventilation assembly 30 can be installed within an intermediate space, outside of the room, area or space, and coupled with one or more ventilation duct assemblies to provide ventilation to the room, area or space. The fluid can comprise air, or other gases, or vapor, such as water vapor. The fluid can comprise a smoke, ash, or other particulate in addition to air or other gases.

In an example, the damper door 46 can be positioned so as to substantially control the flow of fluid from a space (e.g., a room, and/or into the ventilation duct of a building, or structure, to an outside location) while also being capable of controlling the backflow of a fluid through the damper assembly 34 into the main housing 32 through the outlet opening 42. This can be accomplished by employing a damper door 46 shaped to fit within the inner region 315 and to substantially cover the inner region 315 so as to at least partially block the flow of fluid when in a closed position or partially closed position, but can be capable of moving (while remaining coupled to the main body 44) to provide variable flow path through the main body 44.

In an example, the fan assembly 36 can be operable to discharge fluid flow from a space to another location aided in part by the moveable damper door 46. For example, when power is provided to the motor 86, the motor 86 can rotate the blower wheel 92 positioned substantially within a scroll 90. Fluid flow can be moved substantially towards the fan assembly 36 and the damper assembly 34 can open, allowing fluid to be expelled from the fan assembly 36.

In an example, the damper assembly 34 can comprise a pressure activated damper door 46. The pressure activated damper door 46 can be moveable between an open position and a closed position. In at least one example, the pressure-activated damper door 46 can be moved between an open position allowing fluid to enter the damper assembly 34 from the outlet opening 42 in response to positive pressure within the main housing 32 (e.g., when the motor 86 is operating to turn the blower wheel 92 or when the blower wheel 92 is rotating due to momentum transferred from a previously operated motor 86), and a closed position for at least partially preventing external fluid from entering the main housing 32 through outlet opening 42 when the fan assembly 36 is not operating (e.g., when the motor 86 is not operating and the blower wheel 92 is not rotating).

In an example, the damper assembly 34 can comprise a damper door 46 that is passively operated. In at least one example, the damper assembly 34 can comprise a damper door 46 that is at least partially gravity operated. In at least one example, the damper assembly 34 can comprise an actively actuated damper door 46. In at least one example, the damper assembly 34 can comprise a damper door 46 that can be powered and/or moved by a force in addition to gravity.

In an example, the damper door 46 can open due to a positive pressure within the main housing 32. For example, powering the motor 86 can rotate the blower wheel 92 within the main housing 32 which can increase pressure within the main housing 32. In at least one example, the increased pressure can cause a closed damper door 46 to at least partially open, allowing fluid to be expelled from the fan assembly 36 past the damper door 46 through the main body 44. The damper assembly 34 the damper door 46 can form a barrier capable of at least partially controlling a flow of fluid into the ventilation assembly 30. When the external pressure exceeds the pressure within the first region and/or the main housing 32, the moveable damper door 46 coupled within an inner surface 56 adjacent to a transition region 66 can partially close and/or completely close to prevent back-draft.

In an example, the damper door 46 can be pressure-activated and gravity operated. For example, when fan assembly 36 is not operating, and the pressure-activated damper door 46 is in an open or partially open position, the pressure-activated damper door 46 can close further and/or move to a closed position under the force of gravity. In at least one example, from an open or partially open position, the weight of the damper door 46 will force the damper door 46 to rotate towards a closed position. The shape and radius of curvature of the inner surface of the clearance region 86 can enable the damper door 46 to rotate in this manner under gravity within the main body 44 about the rotational axis so that at least a portion of the upper surface of the damper body 76 can rotate within the main body 44 through an arc that includes the radius of curvature of the inner surface of the clearance region 86.

In an example, the fan assembly 36 can include a damper assembly 34 including the two coupled body portions 58, 60 that can comprise a damper door 46 that can be moved by a force other than, or in addition to gravity. In at least one example, the damper door 46 can be moved mechanically or electromechanically. In at least one example, the damper door 46 can be moved electromagnetically. In at least one example, the damper door 46 can be moved hydraulically.

In at least one example, the damper door 46 can be positioned in a fully open position to minimize the obstruction of fluid flow through the main body 44. In this position, the convex outer surface of the damper door 46 can be positioned immediately adjacent to the inner surface of the main body 44. Similarly, the outer edge 78 of the damper door 46 can be positioned to be substantially decoupled from the main body 44. Moreover, in this configuration, the tip of the damper door 46 would have completely traversed the arc that includes the radius of curvature of the inner surface of the clearance region 86, and would have followed the radius of curvature of the inner surface including any certain gap between the upper surface of the damper body 76 and the inner surface, and will longer extend inwards towards the clearance region 86.

In at least one example, when the damper door 46 is in an open position, and is positioned adjacent to the upper portion of the inner surface 56 so that a substantially all the convex outer surface is positioned immediately adjacent to the inner surface of the main body 44. In this instance, during operation of the ventilation assembly 30, fluid can pass the damper door 46 through the first opening 50 of the first region 48 and can then proceed into the second region 52 via the transition region 66. Although some fluid can expand into an area of the second region 52 in which at least a portion of the damper door 46 is positioned in an area defined between the first inner diameter of the first region 48 and the second inner diameter of the transition region 66, a substantially portion of the fluid can travel through the second region 52 within a volume including a diameter that is defined by the first region 48 (and therefore a substantially portion of the fluid can maintain a trajectory that avoids any substantial portion of the damper door 46 within the second region 52).

In at least one example, the damper assembly 34 including the two coupled body portions 58, 60 can operate while coupled to an exhaust fan assembly. Under some circumstances, the damper assembly 34 can be in a closed position even when the fan assembly 36 is operating (e.g., when the blower wheel 92 is rotating). However, in most cases, the fan assembly 36 can include a damper assembly 300 in a closed position when the fan assembly 36 is not operating (e.g., when the motor 86 is not operating and the blower wheel 92 is not rotating). In this instance, the closed damper door 46, positioned against the engagement edge 80, can at least partially prevent external fluid from entering the main housing 32 through outlet opening 42. Further, in this instance, fluid can be at least partially prevented from passing into the damper door 46 by passing through the second opening 52 of the second region 50 within a region of the damper door 46. Moreover, any fluid entering the second region 50 can build-up against the closed damper door 46, which can prevent the fluid from proceeding into the first region 48 within a region of the damper door 46 which includes the first opening 50. In this instance, some fluid can expand into an area of the second region 50 in a portion of the damper door 46, but a substantially portion of the fluid can be prevented from traveling through the second region 50 into a volume defined by the first region 48.

As discussed earlier, in at least one example, the damper assembly 34 can be coupled to a main housing 32 of fan assembly 36 (as illustrated in FIG. 1 showing an exploded view of a fan assembly 36). In at least one example, the damper assembly 34 can be integrated with the main housing 32. As depicted in FIG. 1, after installation of the fan assembly 36, a spring 96 can be used to conveniently secure a grille 98 to the fan assembly 36. The grille 98 can be secured to the ventilation assembly 30 with more than one spring 96 and more than one grille spring holder 100. In at least one example, the grille 98 can be secured to the ventilation assembly 30 by some other component, such as a clip, a wire, a wrap, or adhesive, or the like. The grille 98 can be formed from injection molded polymers, thermo-formed polymers, thermosetting polymers, or sheet metal, or any other suitable material. The main housing 32 can be formed from a sheet metal, including, but not limited to an aluminum-based metal, a steel or iron-based metal, a zinc-based metal, or a nickel and tin-based metal. In at least one example, the main housing 32 can be formed from injection molded polymers, thermo-formed polymers, thermosetting polymers, or any other suitable material. In at least one example, the main housing 32 can comprise a wood-based product, such as wood, or particle-board or wood laminate.

In an example, the dimensions of the main housing 32 enable the fully assembled ventilation assembly 30 to be maneuvered and installed within a standard 2'×4' wall structure. In at least one example, the ventilation assembly 30 can be installed as a new, original equipment installation in a room or building where none had previously existed, whereas in at least one example provide a ventilation assembly 30 that can replace a pre-existing ventilation system.

In an example, the damper assembly 34 can be installed as a new damper assembly 34. The damper assembly 34 can be installed into a new ventilation assembly 30 either during manufacture of the ventilation assembly 30, or by a user or installer just prior to installation of the ventilation assembly 30. In at least one example, the main housing 32 can be pre-installed by inserting into a cavity or aperture of a structure. Following assembly and installation of at least a fan assembly 36 without a pre-installed damper assembly 34, the installer can maneuver the damper assembly 34 onto the fan assembly 36 by coupled with the main housing 32. The ventilation assembly 30 can be fully assembled including the damper assembly 34 and installed directly into a cavity or aperture of a structure.

In an example, the damper assembly 34 can be installed as a new damper assembly onto a pre-existing fan assembly 36. In this instance, the new damper assembly 34 can be installed to replace a broken damper assembly 34, or as an upgrade of an existing damper assembly 34. In this instance, an installer can remove the old damper assembly 34, and maneuver the replacement damper assembly 34 into the fan assembly 36 by coupling the damper assembly 34 with the main housing 32.

Following installation, the position of the damper door 46 can depend on the operational state of the exhaust fan assembly (the motor 86 and the blower wheel 92), and the pressure differential between the space to be ventilated, a ventilation duct coupled to the ventilation assembly 30, or some location fluidly connected with the ventilation assembly 30. When the motor 86 is operating and the blower wheel 92 is rotating, the damper door 46 can open to a fully open position. In at least one example, when the motor 86 is operating and the blower wheel 92 is rotating, the damper door 46 can open to a partially open position.

In an example, to prevent the damper door 46 from causing excessive vibration and noise when the damper door 46 reaches the fully open position, a conventional damper open stop pad can coupled to the damper door 46 at a location of the outer convex surface of damper body 76, and/or within the inner surface 56 (attached to the upper internal surface of the main body 44) so as to be adjacent to the damper door 46 when fully open. In at least one example, at least some portion of the damper door 46 can include a conventional seal and/or damper stop. A compliant material (such as a polymer foam or polymer strip) can be positioned adjacent to the outer edge 78 and/or upper surface of the damper body 76. The conventional seal can be positioned on the concave inner surface of the damper body 76 and/or over the outer edge 78 and/or upper surface of the damper body 76. In an example, the damper door 46 or main body 44 can include a seal or stop that can comprise a soft, mechanically compliant material such as rubber or foam to absorb the mechanical energy of the damper door 46 as it impacts any surface of the main body 44 (such as the upper or lower transition surfaces 80A, 80B).

In an example, the fan assembly 36 can include at least one at least one component configured to modify the flow of fluid within the main housing 32. In at least one example, the component can comprise a discharge grid 102 positioned within the main housing 32 to reduce noise creation in the main housing 32. In at least one example, the damper assembly 34 can include the discharge grid 102 to minimize noise creation in the discharge grid 102.

Figure 7A:
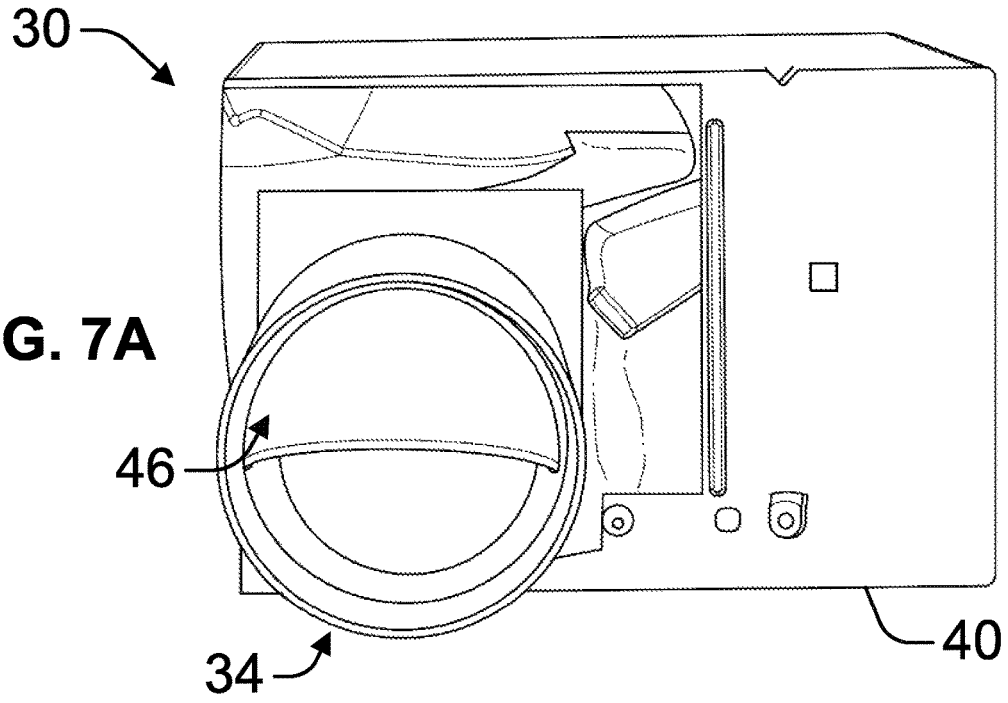
FIG. 7A is a perspective view of a ventilation assembly according to an example of the present disclosure.
Figure 7B:
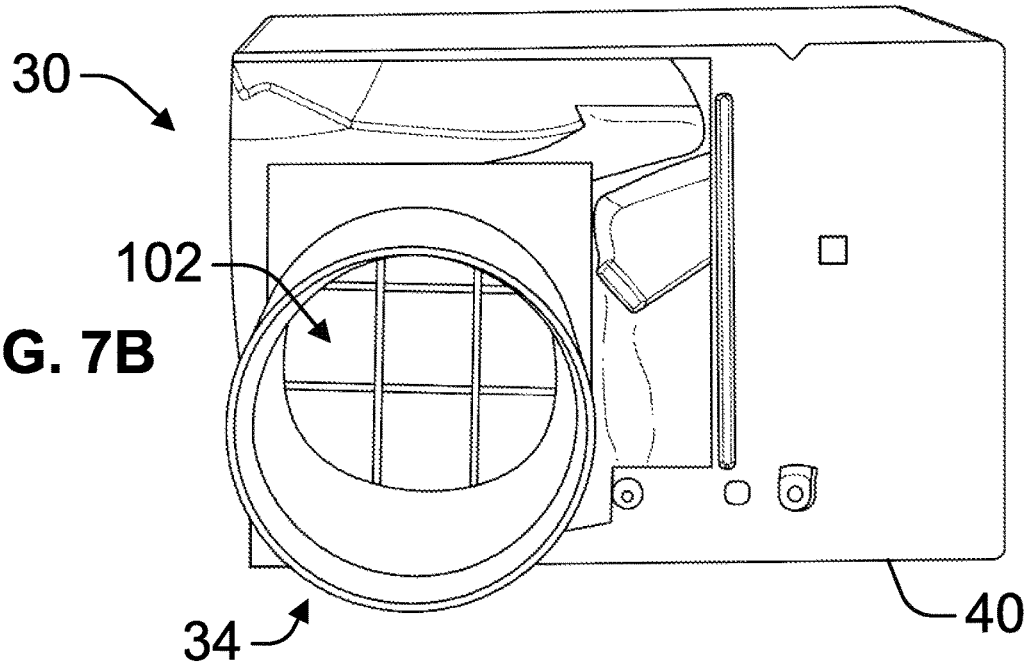
FIG. 7B is a perspective view of a ventilation assembly according to an example of the present disclosure.

As depicted in FIG. 7B, in an example, a discharge grid 102 can be positioned on the main housing 32 at the outlet opening 42 and can be attached to the scroll 90 within the fan assembly 36. In at least one example, the discharge grid 102 can include one or more structures designed to at least partially obstruct and/or guide fluid flow through the outlet opening 42. The discharge grid 102 can include outlet restrictions 104. In at least one example, the outlet restrictions 104 can be integrally formed or molded with the discharge grid 102. In at least one example, the outlet restrictions 104 can be formed as a discrete component and assembled with the discharge grid 102.

In an example, the damper assembly 34 can comprise the discharge grid 102. The damper assembly 34 can be coupled with a discharge grid 102 that can comprise the outlet restrictions 104. In an example, the discharge grid 102 and the damper assembly 34 can be formed as discrete components and coupled together. In at least one example, the discharge grid 102 and the damper assembly 34 can be integrally formed. In at least one example, the discharge grid 102 can be positioned in a region (i.e., within the first region 48) between the damper door 46 and the first opening 50. In at least one example, the discharge grid 102 can be positioned in a region (i.e., within the second region 52) between the damper door 46 and the second opening 54. In at least one example, the damper assembly 34 including a discharge grid 102 can substantially guide fluid and/or reduce noise creation by the fan assembly 36.

Figure 9A:
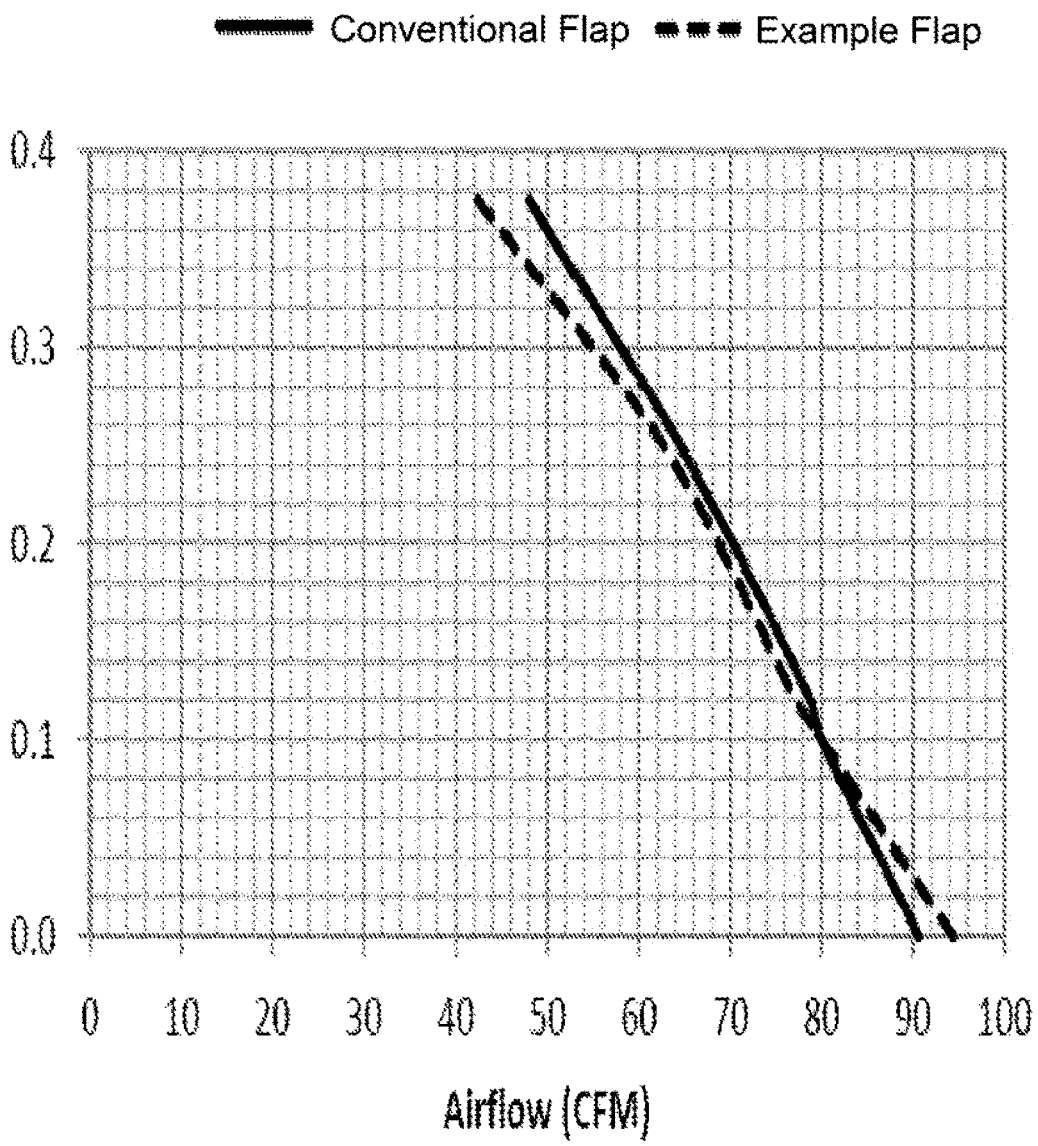
FIG. 9A is a plot of airflow as a function of static pressure comparing a conventional damper door with one example of the damper door according to an example of the present disclosure.
Figure 9B:
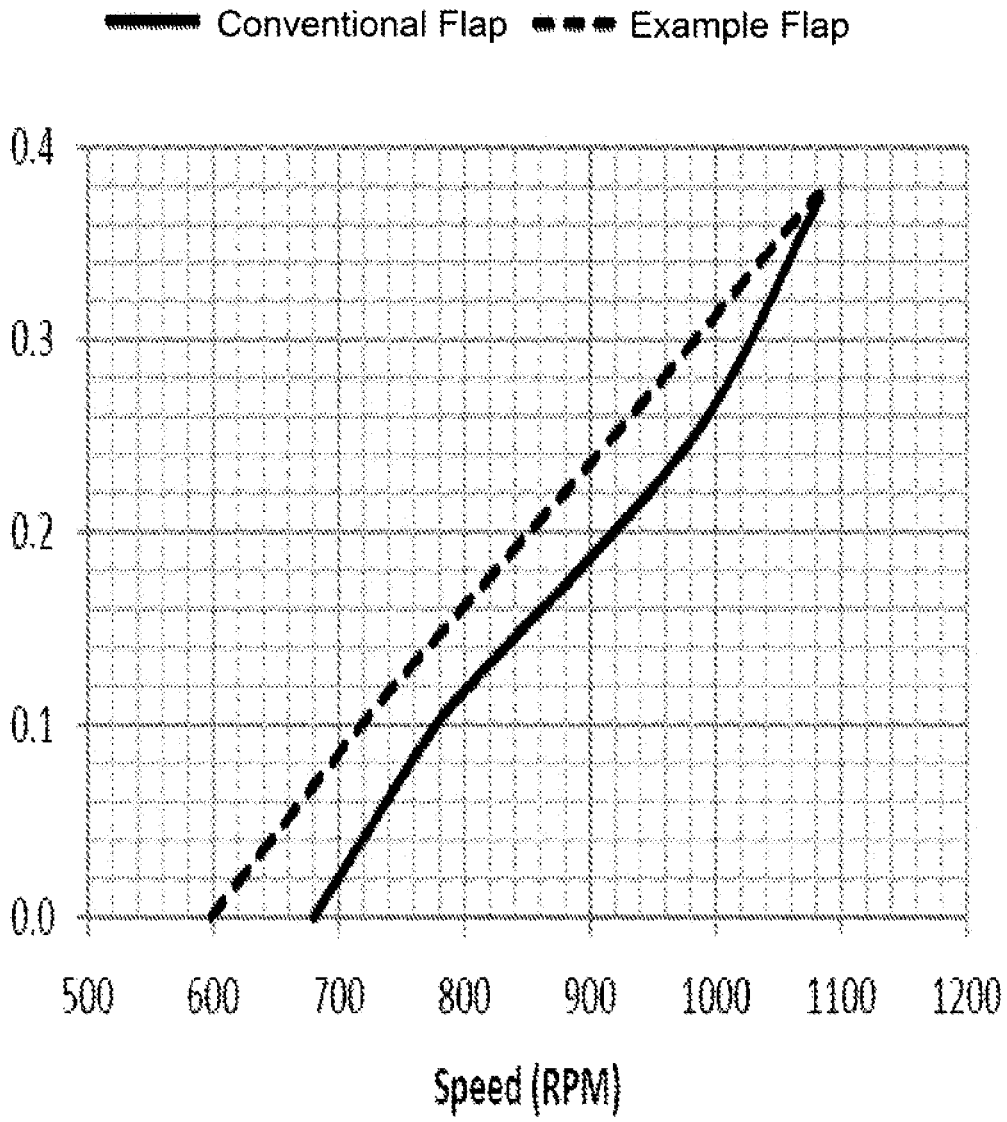
FIG. 9B is a plot of fan speed as a function of static pressure comparing a conventional damper door with one example of the damper door according to an example of the present disclosure.
Figure 9C:
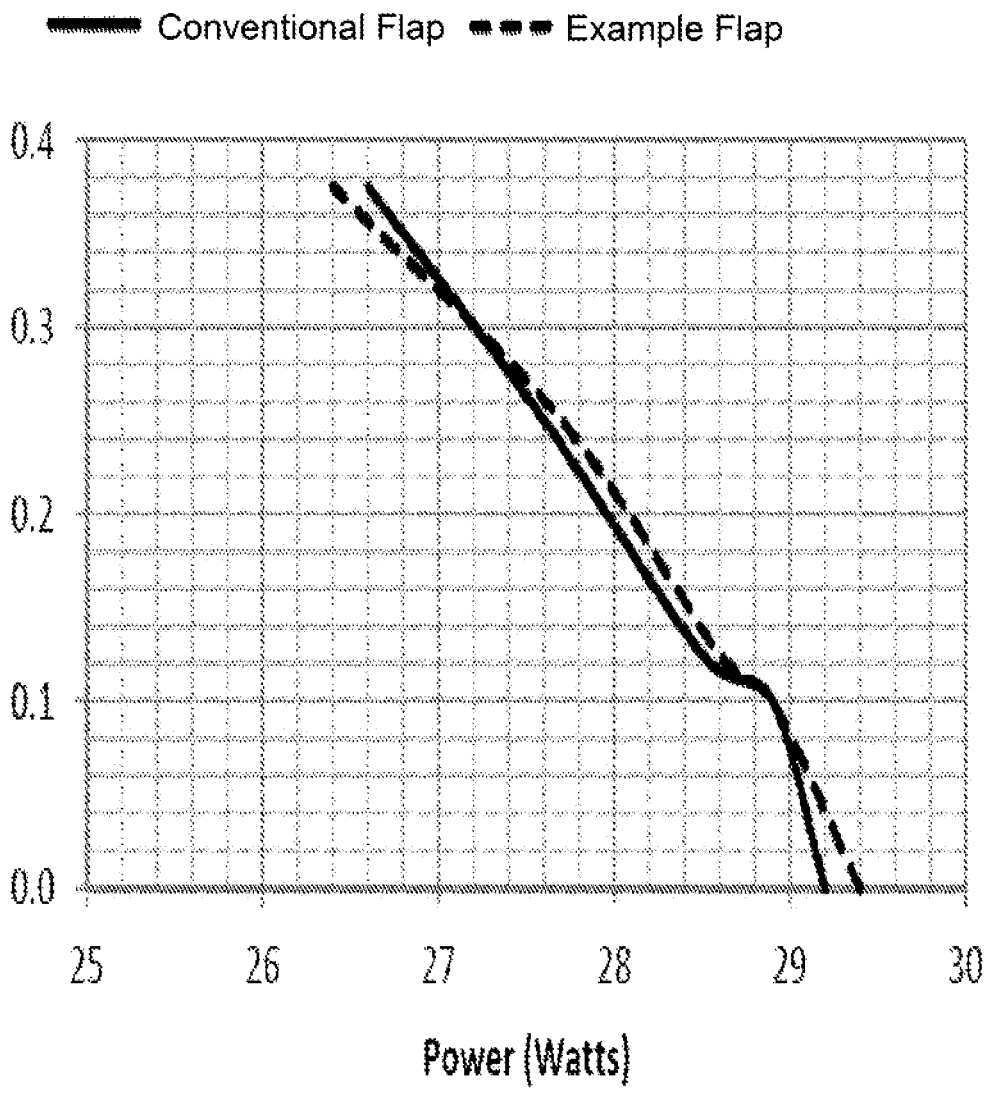
FIG. 9C is a plot of fan power as a function of static pressure comparing a conventional damper door with one example of the damper door according to an example of the present disclosure.
Figure 9D:
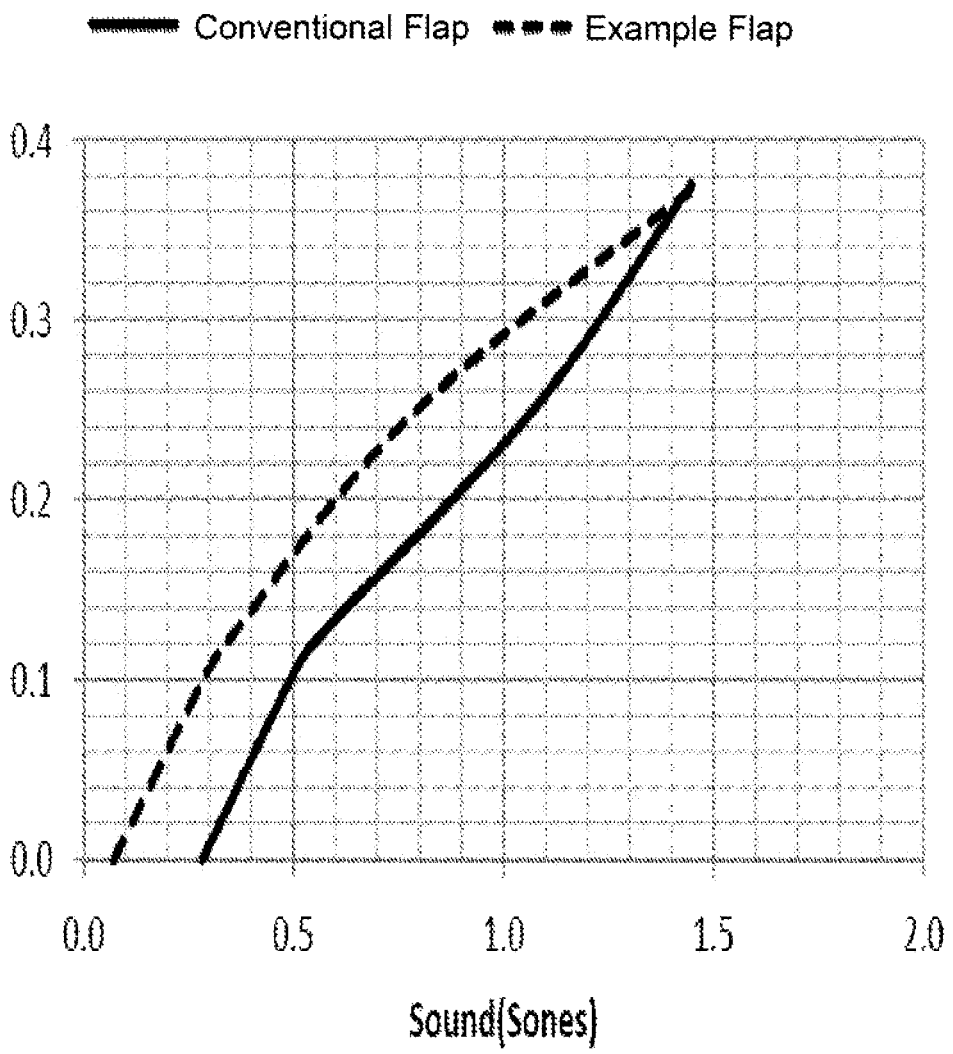
FIG. 9D is a plot of fan sound emitted as a function of static pressure comparing a conventional damper door with one example of the damper door according to an example of the present disclosure.

In an example, the operation characteristics of at least one example of the ventilation assembly 30 can be improved over that of a conventional ventilation exhaust fan assembly. Compared to conventional damper doors that remain in the air stream when fully open, the ventilation assembly 30 includes a damper door 46 that can include improved fan performance by moving completely out of the air stream. For example, FIG. 8 shows tables including exhaust fan operational parameters comparing data for conventional damper doors with one example of the damper door 360 according to at least one example. Further, the exhaust fan operational parameters can be visualized graphically in FIGS. 9A-9D. For example, FIG. 9A A shows a plot of airflow as a function of static pressure comparing a conventional damper door with one example of the damper door 360 according to at least one example, and FIG. 9B shows a plot of fan speed as a function of static pressure comparing a conventional damper door with one example of the damper door 360 according to at least one example. FIG. 9C shows a plot of fan power as a function of static pressure comparing a conventional damper door with one example of the damper door 360 according to at least one example, and FIG. 9D shows a plot of fan sound emitted as a function of static pressure comparing a conventional damper door with one example of the damper door 46 according to an example. As illustrated in FIGS. 8 and 9A-9D, in at least one example, the ventilation assembly 10 can be shown to provide substantially the same airflow and power usage when compared with a conventional ventilation exhaust fan assembly. Further, the ventilation assembly 10 can be shown to provide substantially the same airflow and with lower fan speed and sound when compared with conventional ventilation exhaust fan assemblies comprising a conventional damper door.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code can form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) can be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

What is claimed is:

1. A damper assembly, comprising:

a main body having an inner surface defining a continuous fluid path extending between a first opening and a second opening, the main body defining an engagement edge including a beveled edge extending circumferentially on the inner surface; and a damper door having an outer edge and rotatably mounted to the main body such that the damper door is rotatable relative to the main body between at least an open position and a closed position and is biased by gravity into the closed position;

wherein at least a portion of the outer edge of the damper door is engaged to the engagement edge when the damper door is positioned in the closed position and the outer edge of the damper door is disengaged from the engagement edge when the damper door is positioned in the open position; and wherein contact between the damper door outer edge and the main body beveled edge prevents rotation of the damper door past the closed position.

2. The damper assembly of claim 1, wherein the engagement edge is oriented on the inner surface such that the surface area of the outer edge engaged to the engagement edge gradually increases as the damper door is rotated from the open position into the closed position to gradually seal the damper door to the main body.

3. The damper assembly of claim 1, wherein the damper door fluidically isolates the first opening from the second opening when the damper door is positioned in the closed position.

4. The damper assembly of claim 3, wherein the damper door is rotatable to a partially closed position between the closed position and the open position;

wherein the damper door limits fluid flow between the first opening and the second opening in the partially closed position.

5. The damper assembly of claim 1, wherein the damper door defines an outer surface;

wherein the outer surface of the damper door is positioned adjacent the inner surface of the main body when the damper door is positioned in the open position.

6. The damper assembly of claim 5, wherein the main body is cylindrical such that the inner surface is concave;

wherein the damper door has a convex outer surface curved to correspond to the concave inner surface of the main body.

7. The damper assembly of claim 5, wherein the main body includes a clearance region defining a portion of the inner surface;

wherein the outer surface of the damper door is rotated adjacent the clearance region portion of the inner surface when rotated into the open position.

8. The damper assembly of claim 7, wherein the clearance region is recessed such that at least a portion of the damper door is received within the clearance region when the damper door is rotated into the closed position.

9. The damper assembly of claim 7, wherein the damper door is positioned to define a clearance gap between the clearance region portion of the inner surface and the outer surface of the damper door.

10. The damper assembly of claim 7, wherein a pad is coupled to at least one of the outer surface of the damper door and the inner surface at the clearance region to cushion engagement between the damper door and the main body.

11. The damper assembly of claim 1, wherein the main body includes at least one coupler defining a receptacle; and wherein the damper door includes at least one attachment pin receivable within the receptacle to rotatably mount the damper door to the main body.

12. The damper assembly of claim 11, wherein the coupler is positioned on a top portion of the inner surface such that the damper door is biased by gravity into the closed position.

13. The damper assembly of claim 1, wherein the main body includes a first body portion and a second body portion couplable to the first body portion.

14. The damper assembly of claim 13, wherein the first body portion includes at least one tab and the second body portion includes at least one slot corresponding to the tab;

wherein the at least one tab of the first body portion is insertable into the corresponding slot of the second body portion, the first body portion and the second body portion cooperate to define the inner surface.

15. A ventilation assembly, comprising:

a main housing defining an interior space and having an inlet opening and an outlet opening;

a fan assembly positionable within the interior space and including a fan operable to move fluid into the inlet opening and out of the outlet opening; and a damper assembly positionable at the outlet opening, the damper assembly including:

a main body having an inner surface defining a continuous fluid path extending between a first opening and a second opening, the main body defining an engagement edge including a beveled edge extending circumferentially on the inner surface, the first opening positionable to receive the fluid from the outlet opening; and a damper door having an outer edge and rotatably mounted to the main body such that the damper door is rotatable relative to the main body between at least an open position and a closed position and is biased by gravity into the closed position;

wherein at least a portion of the outer edge of the damper door is engaged to the engagement edge when the damper door is positioned in the closed position and the outer edge of the damper door is disengaged from the engagement edge when the damper door is positioned in the open position; and wherein contact between the damper door outer edge and the main body beveled edge prevents rotation of the damper door past the closed position.

16. The ventilation assembly of claim 15, wherein the engagement edge is oriented on the inner surface such that the surface area of the outer edge engaged to the engagement edge gradually increases as the damper door is rotated from the open position into the closed position to gradually seal the damper door to the main body.

17. The ventilation assembly of claim 15, wherein the damper door fluidically isolates the first opening from the second opening when the damper door is positioned in the closed position to prevent the fluid from moving between the first opening and the second opening.

18. The ventilation assembly of claim 17, wherein the damper door is rotatable to a partially closed position between the closed position and the open position;

wherein the damper door obstructs fluid flow between the first opening and the second opening in the partially closed position.

19. The ventilation assembly of claim 15, wherein the damper door defines an outer surface;

wherein the outer surface of the damper door is positioned adjacent the inner surface of the main body when the damper door is positioned in the open position.

20. The ventilation assembly of claim 19, wherein the main body is cylindrical such that the inner surface is concave;

wherein the damper door has an convex outer surface curved to correspond to the inner surface of the main body.

21. The ventilation assembly of claim 19, wherein the main body includes a clearance region defining a portion of the inner surface;

wherein the outer surface of the damper door is rotated adjacent the clearance region portion of the inner surface when rotated into the open position.

22. The ventilation assembly of claim 21, wherein the clearance region is recessed such that at least a portion of the damper door is received within the clearance region when the damper door is rotated into the closed position.

23. The ventilation assembly of claim 21, wherein the damper door is positioned to define a clearance gap between the clearance region portion of the inner surface and the outer surface of the damper door.

24. The ventilation assembly of claim 21, wherein a pad is coupled to at least one of the outer surface of the damper door and the inner surface at the clearance region to cushion engagement between the damper door and the main body.

25. The ventilation assembly of claim 15, wherein the main body includes at least one coupler defining a receptacle; and wherein the damper door includes at least one attachment pin receivable within the receptacle to rotatably mount the damper door to the main body.

26. The ventilation assembly of claim 25, wherein the coupler is positioned on a top portion of the inner surface such that the damper door is biased by gravity into the closed position;

wherein generating a flow through the outlet opening of the main housing pushes the damper door into the open position.

27. The ventilation assembly of claim 15, wherein the main body includes a first body portion and a second body portion couplable to the first body portion.

28. The ventilation assembly of claim 27, wherein the first body portion includes at least one tab and the second body portion includes at least one slot corresponding to the tab; wherein the at least one tab of the first body portion is insertable into the corresponding slot of the second body portion, the first body portion and the second body portion cooperate to define the inner surface.

29. A damper assembly, comprising:

a main body having an inner surface defining a continuous fluid path extending between a first opening and a second opening, the main body including a beveled edge extending circumferentially on the inner surface and a diameter of the inner surface closer to the second opening from the beveled edge is larger than a diameter of the inner surface closer to the first opening from the beveled edge; and a damper door having an outer edge and rotatably mounted to the main body such that the damper door is rotatable relative to the main body between at least an open position and a closed position and is biased by gravity into the closed position;

wherein substantially all of the damper door opens into a clearance region defined by the larger diameter.

30. The damper assembly of claim 29, the damper door having a curvature corresponding to a curvature of the inner surface defining the larger diameter.

31. The damper assembly of claim 29, wherein a substantial portion of fluid travelling from the first opening to the second opening through the main body can maintain a trajectory that avoids any substantial portion of the damper door.

32. A damper assembly, comprising:

a main body having a concave inner surface defining a continuous fluid path extending between a first opening and a second opening;

a damper door having a convex outer surface curved to correspond to the concave inner surface of the main body, the damper door defining an outer edge; and the main body having at least one receptacle between the first opening and the second opening and the damper door having at least one attachment pin receivable within the at least one receptacle to rotatably mount the damper door to the main body such that the damper door is rotatable relative to the main body between at least an open position and a closed position, wherein substantially all of the at least one receptacle is located outside of the concave inner surface and out of the fluid path.

33. The damper assembly of claim 32, the main body including a beveled edge defining an engagement edge extending circumferentially on the inner surface.

34. The damper assembly of claim 32, wherein the damper door fluidically isolates the first opening from the second opening when the damper door is positioned in the closed position.

35. The damper assembly of claim 32, wherein the damper door is rotatable to a partially closed position between the closed position and the open position; wherein the damper door limits fluid flow between the first opening and the second opening in the partially closed position.

* * * * *